US005237935A

United States Patent [19]

Newhouse et al.

[11] Patent Number: 5,237,935

[45] Date of Patent: Aug. 24, 1993

[54] WORK ENVIRONMENT SYSTEM

[75] Inventors: Thomas J. Newhouse, Grand Rapids; Donald D. Goeman, Holland; Duane G. McClung, Kalamazoo, all of Mich.

[73] Assignee: Herman Miller, Inc., Zeeland, Mich.

[21] Appl. No.: 786,250

[22] Filed: Oct. 31, 1991

Related U.S. Application Data

[60] Continuation of Ser. No. 408,700, Sep. 18, 1989, Pat. No. 5,083,512, which is a division of Ser. No. 162,597, Mar. 1, 1988, Pat. No. 4,884,513.

[51] Int. Cl.[5] ..... A47B 35/00

[52] U.S. Cl. ..... 108/50; 312/223.6

[58] Field of Search ..... 108/50; 312/223.6, 223.1, 312/223.3

[56] References Cited

U.S. PATENT DOCUMENTS

| | | | |
|---|---|---|---|
| 4,053,701 | 10/1977 | Ogilvie | 312/223.6 X |
| 4,748,913 | 6/1988 | Favaretto et al. | 108/50 |
| 4,762,072 | 8/1988 | Boundy et al. | 108/50 |
| 4,852,500 | 8/1989 | Ryburg et al. | 108/50 X |

FOREIGN PATENT DOCUMENTS

| | | | |
|---|---|---|---|
| 2716941 | 10/1970 | Fed. Rep. of Germany | 312/223.6 |
| 2717183 | 11/1978 | Fed. Rep. of Germany | 312/223.6 |
| 8100965 | 4/1981 | PCT Int'l Appl. | 312/223.6 |

*Primary Examiner*—Jose V. Chen

*Attorney, Agent, or Firm*—Varnum, Riddering, Schmidt & Howlett

[57] ABSTRACT

In a work environment system, a desk (10) comprises a top (16) supported by a pair of legs (18), each leg (18) formed by a pair of supports (22) mounted together in back-to-back opposing relationship and having a first channel (56) between the supports (22). The desk top (16) includes a pair of second channels (98) extending inwardly from edges (100) of the top (16) adjacent the second channels (56). The first and second channels (56, 98) manage wiring (60) of work accessories (62, 105) supported by the top (16). An apron (20) is mounted to and below the top (16) and comprises third channel (218) in registry with the first channel (56) and also adapted to receive wiring (60) from the second channels (98) through outer and inner slots (114, 116) in the top (16). A work accessory support (222) is removably mountable to the desk (10) by a bracket (224) securable to a leg (18) within a first channel (56) on one side of the desk (10). A work tool support fence (260) supporting trays (292) is similarly mountable to both legs (18) of the desk (10). Two desks (10) can be mounted together in side-by-side relationship by a semi-circular spacer (306) comprises one or more wedge elements (310). The spacer includes a fourth channel (328) for managing the wiring (60) between the adjacent desks (10).

35 Claims, 15 Drawing Sheets

WORK ENVIRONMENT SYSTEM

This is a continuation of application Ser. No. 07/408,700 filed Sep. 18, 1989, now U.S. Pat. No. 5,083,512, which is a division of application Ser. No. 07/162,597, filed Mar. 1, 1988, now U.S. Pat. No. 4,884,513 issued Dec. 5, 1989.

FIELD OF THE INVENTION

The invention relates to a work environment system comprising desks having wire and work accessory support management capability and more particularly to desks comprising work surfaces supported by legs, the work surfaces and legs having wire management capability and adapted to support work accessories, and means for wire management between the desks.

BACKGROUND OF THE INVENTION

Traditionally, office and commercial work environments have been characterized by permanent or semi-permanent space divider walls which define individual work areas. Such work areas have been furnished with furniture of the conventional type, that is, furniture entirely or substantially entirely independent of the walls. Conventional furniture design is often desirable because of the privacy it affords workers Such arrangements, however, are not without drawbacks and are considered in many ways undesirable for use in modern office and commercial environments.

First, although traditional office layout may be adequate under circumstances in which the requirements of the activities performed in the work area remain relatively static over long periods of time, under modern office and commercial conditions, such systems have proved inadequate. Modern office and commercial environments are typically characterized by activities which constantly change. This phenomenon results from, for example, the fact that what is considered as an appropriate working environment for a particular activity rapidly changes. In addition, the fundamentals of the activities themselves constantly change. Thus, the concept of using a "built-in" space dividing system and conventional furniture immediately creates a problem when a change is to be made. The cost and time requirements of changing the space divider system is often so great that the necessary and desirable changes are frequently not made. Indeed, the space divider scheme originally erected and the furnishings within the work areas defined by the scheme are often used long after they have obtained functional obsolescence because of the cost of reorganization and replacement necessary to restore functional utility.

Second, conventional office designs and the furniture associated therewith have been considered undesirable for use in modern office environments because of their inability to accommodate wiring associated with modern work tools, e.g., computers, telephone systems, etc. Functionally effective and aesthetically desirable wire management necessitates costly modification of the space divider walls. And, the furniture, such as the conventional freestanding desk, can not effectively manage the numerous cables associated with such equipment which necessitates the open exposure of such wiring from work surfaces to floor which is not only aesthetically undesirable but also dangerous to workers hurriedly moving in the work area.

To overcome the problems presented in the modern work environment by conventional furniture design, in the early 60s, work environment systems capable of rapid changeover from one arrangement to another were developed. See, for example, U.S. Pat. No. 3,414,765, to Propst et al., issued Aug. 16, 1966, which discloses the concepts of the now well-known work environment system of the so-called "open-plan" type. Open plan work environment systems typically include a number of workstations defined by a plurality of freestanding walls generally detachably joined together in a number of ways to form workstations of varying size and configuration, with the walls serving as visual and audio barriers between the workstations. The freestanding walls not only subdivide the work area, but they also provide a means upon which functional components, such as work surfaces, cabinets and the like, can be mounted. The functional components can be positioned in a number of locations within the workstations to adapt the same to the demands of different activities. The functional components, while supported by the freestanding walls, are wholly independent of the same so that the components could be completely interchanged and installed for use with any one or more of the freestanding walls of the workstations. In addition, because the freestanding walls of the open plan office system are adapted to be rearranged from one pattern of organization to another, the workstations can be quickly changed over in size, shape, orientation and arrangement to adapt the work environment system to new requirements as the usage of the work space changes from time to time. Other open plan work environment systems particularly adapted for use in modern office environments are manufactured and sold by Applicant's assignee, Herman Miller, Inc., of Zeeland, Michigan, under the trademarks ACTION OFFICE and ETHOSPACE The open plan office system has particular advantages over conventional office design in the manner in which it manages wiring of modern-day office equipment. Most commonly, the freestanding walls forming the workstations are provided with channels for housing such wiring. Because a typical open plan office system can include a network of freestanding walls spanning across a work area, wiring for electronic equipment utilized in the numerous workstations can be housed within the channels of the walls and thus hidden from view and in a position not to cause potential hazards to workers.

In addition, modern office designs can be include systems for organizing papers, folders, books, among other items normally associated with business activities. Because organization of work space in modern office systems is vital to work space efficiency and to obtaining a quality work product, a means in the work space which promotes such organization is very desirable. For example, open plan office systems have been known to include panels forming series of vertically spaced horizontal support rails having channels adapted to receive downwardly-depending hooks of work accessories to removably mount the work accessories to the rails. Conventional office designs do not specifically afford convenient placement of such rail-containing panels for access thereto by workers situated at conventional freestanding desks. Indeed, rails of similar type may be mounted to permanent interior walls spaced a relatively great distance from a worker's desk or incorporated within freestanding cabinetry positioned directly adjacent such permanent walls. See, for example, U.S. Pat. Nos. 4,274,687, to Bayles et al., and 4,174,486, to Winkler, issued Jun. 23, 1981 and Nov. 13, 1986, respectively, both of which disclose freestanding cabinetry incorporating series of horizontally stacked rails adapted to removably support work accessories.

The freestanding walls of open plan office systems provide a convenient support for work accessory support rails and thus have been so used. See, for example, U.S. Pat. No. 4,685,255, to Kelly et al., issued Aug. 11, 1987. In addition, work accessory support rails have been mounted into cabinets mountable to the freestanding walls as disclosed in U.S. Pat. No. 4,618,192, to Kelley, issued Oct. 21, 1986.

Although the open plan office furniture system has many advantages in that it is able to readily accommodate the demands of the modern-day work environment, it is not without its disadvantages. Most objected to is the detrimental psychological impact such furniture systems have on workers. Although the freestanding walls between workstations defined thereby were originally believed to positively affect worker morale by serving as visual and audio barriers between workstations and thus providing privacy to workers, it is now felt that placing workers in a maze of nearly identical work cubicles may actually lower worker morale. Such work environments are believed to have a "sterilizing" effect on workers who come to feel anonymous, resulting in a less than adequate work product. In addition, because the freestanding walls of the open plan modern office system are typically less than full height, one workstation defined by the walls may not be effectively insulated from sounds generated in a neighboring workstation.

Therefore, recently the dogmas of both the "conventional" office (rows of private offices with internal bull pens) and the "open" office (workers in a maze of cubicles) are drawing heavy criticism. It has been thus found desirable to provide a hybrid approach to office design which combines cellular offices, open plan workstations, freestanding furniture, full-height walls, departmental subdivisions, etc., into a heterogeneous interior space. It has been also desirable to provide such a hybrid which not only takes advantage of the positive attributes, e.g., privacy, flexibility, wire management, of both the conventional and open plan designs, but also eliminates as much as practicable the disadvantages. It has further been desirous to provide such heterogeneous system which is compatible with presently used open plan and conventional office systems.

For example, there has been provided freestanding desks having channels or wiring ducting beneath the desk tops and within the desk legs or pedestals as disclosed in the following U.S. Pat. Nos. Ball et al., 3,635,174, issued Jan. 18, 1972; Holper et al., 4,094,256, issued Jun. 13, 1978; Hildebrandt et al., 4,296,981, issued Oct. 27, 1981; and Ball, 4,323,291, issued Apr. 6, 1982.

It is the object of the present invention to provide an office system including freestanding desks providing the privacy afforded by conventional systems and the flexibility and wire and work accessory management associated with open plan designs and which is not only functional but also aesthetically pleasing.

SUMMARY OF THE INVENTION

According to the invention, a desk comprises a top and at least one leg supporting the top. The leg includes a first support having a first substantially vertical portion and a first mounting means extending from the first vertical portion. The leg also includes a second support having a second substantially vertical portion and a second mounting means extending from the second vertical portion. The first and second supports are mounted together in inverted relationship at the first and second mounting means. The first and second mounting means are complementary to one another only when the supports are positioned in inverted relationship. The leg further includes securing means cooperating with the first and second mounting means to securely mount the first and second supports together in inverted relationship.

The first and second mounting means are identical and each comprises at least one pair of plates on the respective support, the pair of plates on the first support being complementary to and positioned in overlapping engagement with the pair of plates on the second support only when the supports are positioned in inverted relationship.

The desk also comprises right and left ends and front and rear sides. The first and second vertical portions are substantially identical with respect to position of the pair of plates thereon. The first support is mounted to one of the right and left ends at one of the front and rear sides. The second support is mounted to the first support, with the second vertical portion positioned in inverted relationship with respect to the first vertical portion to position the pairs of plates in overlapping complementary relationship at the other of the front and rear sides.

The securing means comprises a pair of aligned openings extending through each pair of the complementary overlapping plates on the first and second supports and a screw in registry with the pair of aligned openings and threadably engaging the complementary plates.

In one embodiment of the invention, the first and second supports are mounted together in spaced-apart relationship, and the leg further comprises a leg channel defined by and between the first and second supports and the pairs of complementary plates. The channel receives wiring of work tools supported on the desk top.

In another embodiment of the invention, the desk top comprises an end edge, a work surface, a bottom surface and a central portion. The desk further includes slot means within one of the right and left desk top ends, adjacent the end edge and extending inwardly therefrom to a position adjacent the central portion of the desk top; wire manager means received within the slot means and enclosing a desk top channel for receiving wiring of work tools supported on the desk top; and means for securely fastening the wire manager means to the top in registry with the slot means. The wire manager means includes an inner end adjacent to the desk top central portion, an outer end adjacent to the desk top end edge and a pair of inner and outer openings at the inner and outer ends, respectively, for providing access of wiring to and from the desk top channel.

In a further embodiment of the invention, the desk comprises work tool support means for adjustably supporting a work tool in a variety of positions above the desk top for convenient access thereto. Attachment means removably attaches the work tool support means to one pair of the overlapping complementary plates on the first and second supports.

In another embodiment of the invention, the desk comprises opposite ends, another leg substantially identical with the one leg, the legs being positioned at the desk opposite ends, and means for supporting work tools in positions for convenient access thereto. The work tool support means comprises rail means for removably supporting work tools and rail attachment means for removably mounting the rail means to one pair of the complementary plates at each of the desk ends.

According to the invention, there is further provided a desk having a top and at least one leg supporting the top. The leg has a first support, a second support, means for securely mounting the first and second supports together in spaced relationship and a leg channel defined by and between the first and second supports and the mounting means. The leg channel is adapted to receive wiring of work tools positioned on the desk top. The mounting means comprises at least one pair of overlapping plates on and extending from the first and second supports, and securing means for rigidly securing the plates together in overlapping relationship. The securing means comprises a pair of aligned holes extending through the overlapping plates and a screw in registry with the holes and threadably engaging the plates. The desk top also includes a first transverse end and front and rear sides, with the leg being positioned at the first transverse end. The first and second supports are disposed at the desk top front and rear sides, respectively, and the plates on the first and second supports extend rearwardly and forwardly thereof, respectively.

In this latter embodiment, the desk top further comprises a second transverse end and the desk also includes another leg identical to the one leg and positioned at the second transverse end. Panel means is mounted to and between the legs and defines a channel means in registry with the leg channels. Wiring can be channeled from the desk to the floor and between the leg channels through the leg channels and the channel means. Also in this latter embodiment, the desk comprises means at the desk top front side for supporting a work tool, and bracket means for movably mounting the support means to the desk at a variety of adjusted positions. Electrical wiring of work tools supported by the support means can be channeled from the desk top to the floor through the leg channel.

The invention also contemplates the concept of a desk having a top and a first end, a first end edge, a work surface, a bottom surface and a central portion, wherein the desk also includes a slot means, a wire manager means and a fastening means. The slot means is within the top first end, is adjacent the first end edge and extends inwardly therefrom to a position adjacent the central portion. The wire manager means is received within the slot means and encloses a desk top channel for receiving wiring of work tools positioned on the work surface. The fastening means secures the wire manager means to the top in registry with the slot means The wire manager means further includes an inner end adjacent the desk top central portion, an outer end adjacent the desk top end edge and a pair of inner and outer openings at the inner and outer ends, respectively, for providing access of wiring to and from the desk top channel.

In this latter concept, the wire manager means further comprises a base portion securely fastened to the desk top, substantially equal in length to and received within the slot means and having first and second longitudinal sidewalls, a bottom wall, an open top and a cover mounted to the base portion over the open top, the desk top channel being substantially enclosed by the base portion sidewalls, bottom wall and cover.

Also, according to the invention, the following concept is provided: a desk comprising opposite ends, a top having a work surface and a bottom surface, panel means extending horizontally between the opposite desk ends and substantially vertically downwardly from the bottom surface a predetermined distance for providing privacy to a worker at the desk, and means for mounting the panel means to the desk. The desk top further includes a slot means extending therethrough. The panel means also includes a channel means extending substantially the full length thereof and in registry with the slot means. Wiring of work tools on the work surface can be channeled from the work surface to the desk opposite ends through the channel means and the slot means.

The invention further contemplates the combination of a desk and a work tool support adapted to be mounted to the desk for supporting work tools above a desk top. The work tool support comprises rail means for removably supporting work tools and rail attachment means for removably attaching the rail means to the desk to support work tools in positions for convenient access thereto above the desk top. The rail means comprises a plurality of vertically spaced horizontal support rails, whereby the support rails are adapted to support work tools at a plurality of vertical and horizontal positions above the desk top.

Further, in accordance with the invention, a workstation comprises at least two desks and means for connecting the desks together in end-to-end spaced relationship, each of the desks comprising a top supported by at least one leg. The legs comprise substantially vertical channels extending along lengths of the legs for receiving electrical wiring of work tools positioned on the desk tops. The connecting means comprises a substantially horizontal connecting channel extending the full length of the connecting means and in registry with the leg channels for receiving electrical wiring channeled through the leg channels. Electrical wiring of work tools supported on one desk top can be channeled to the other desk through the leg channel of the one desk and the connecting channel.

The connecting means is substantially wedge-shaped and is adapted to connect the desks together in end-to-end relationship at a predetermined angle formed by front edges of the desk tops.

The invention further contemplates a workstation comprising at least two desks and a means for connecting the desks together in end-to-end spaced relationship, with each of the desks comprising a top. Each of the desk tops comprises slot means extending therethrough. The connecting means comprises a connecting channel extending the full length thereof and in registry with the slot means of the desk tops. Electrical wiring of work tools supported on one desk top can be channeled to the other desk through the slot means of the one desk and the connecting channel.

BRIEF DESCRIPTION OF THE DRAWINGS

The invention will now be described with reference to the drawings in which.

DESCRIPTION OF THE PREFERRED EMBODIMENTS

Figure 1:
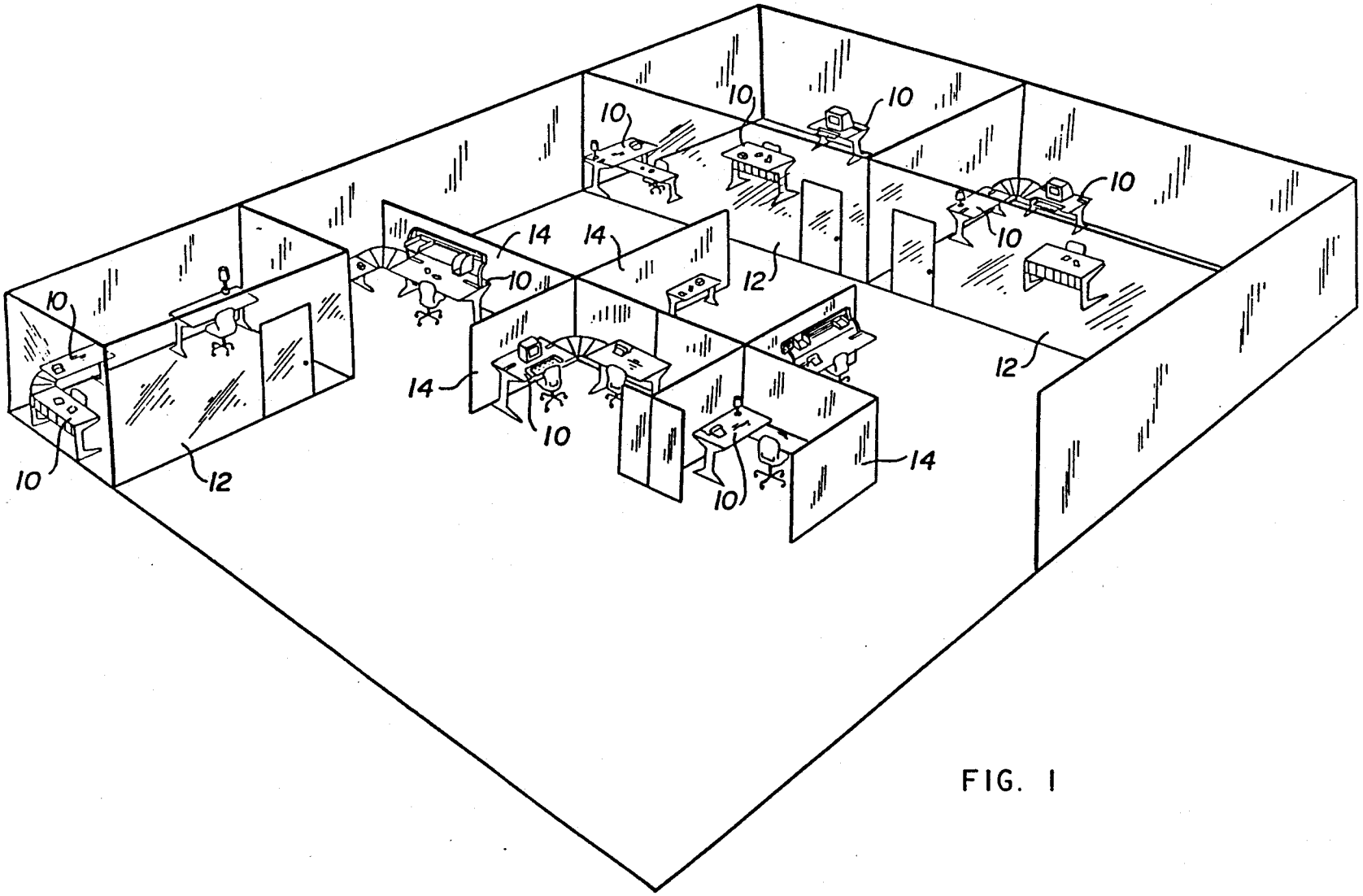
FIG. 1 is a front perspective view of a work environment system according to the invention.

Referring now to the drawings and in particulur to FIG. 1, there is shown a work environment system generally comprising a plurality of freestanding desks 10 of various size useful in functional combination with permanent interior walls 12 and freestanding "half-height" panels 14 and the components mountable thereon, the panels being of the type associated with a modern office system of the so-called "open plan" type. The desks 10 can be combined and linked together in various numbers and geometrical arrangements by semicircular connectors hereinafter described in detail. The desks 10 include wire management channels, hereinafter described, for housing various wiring for electronically powered work accessories, such as lamps, computers and the like. Additionally, the desks 10 can have mounted thereto work tool support means, also hereinafter described, adapted to removably mount work tools in a variety of arrangements to organize work product for workers situated at the desks. In this manner, the desks 10 provide a functionally efficient as well as aesthetically attractive work environment system having advantages of the conventional and open plan office designs while eliminating as much as practicable the disadvantages associated with such designs as heretofore described.

Figure 2:
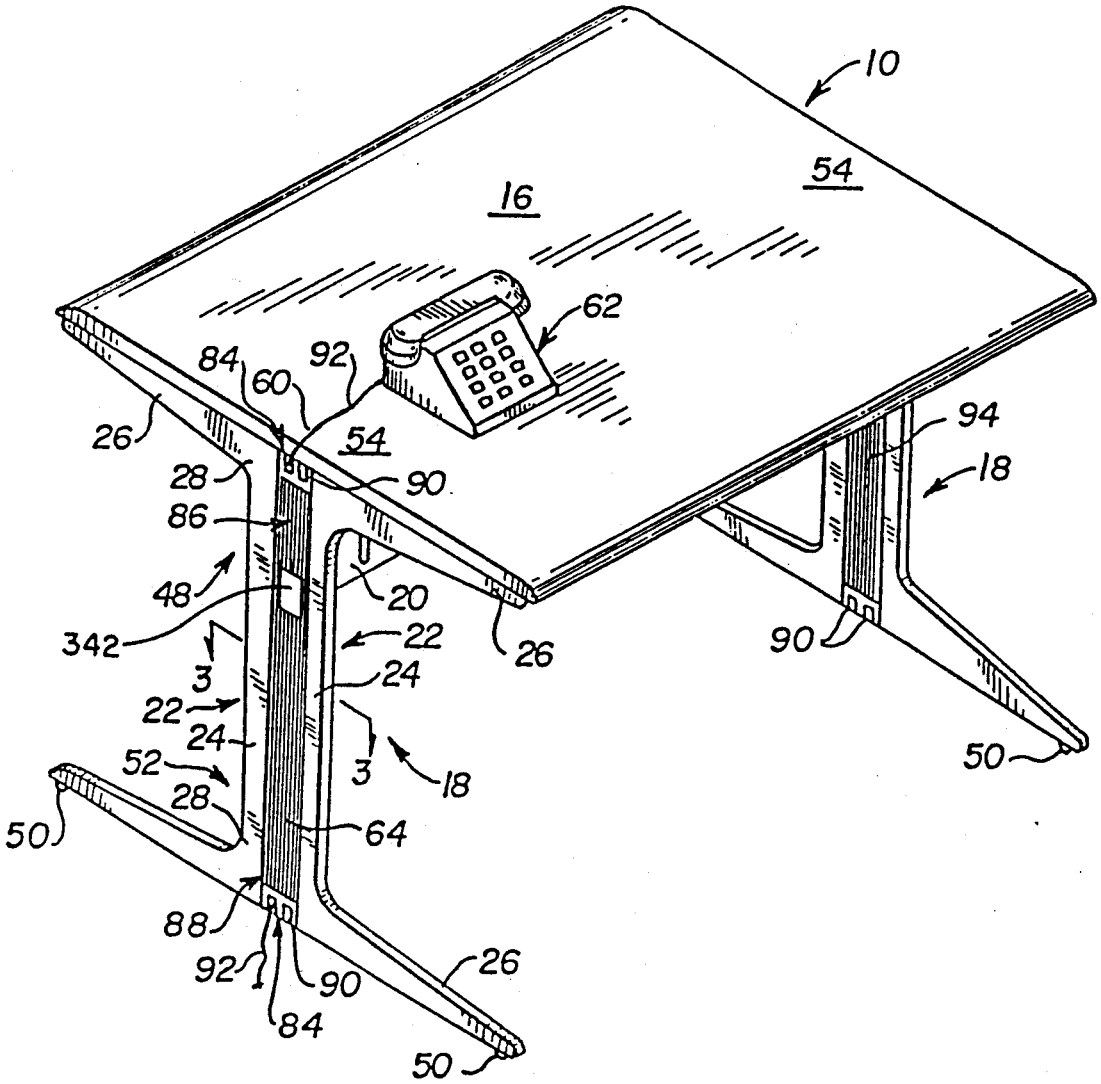
FIG. 2 is a rear perspective view of a desk of the work environment system.

Referring now to FIG. 2, there is shown one of many embodiments of the desk 10, other embodiments being described below. The desk 10 comprises a desk top 16 supported by a pair of legs 18. The desk 10 can also include an apron 20 (hereinafter sometimes referred to as "panel means") mounted to and between the legs 18 and the top 16. The apron 20 extends between the desk legs 18 and is mounted to and extends downwardly from the desk top 16 a predetermined distance. In this manner, the apron functions as a modesty panel to shield from view articles or users at the desk. The apron 20 also has wire management capability as is discussed hereinafter in detail.

Each desk leg 18 comprises a pair of identical front and rear leg supports 22 securely mounted together in inverted, opposing, back-to-back relationship. The supports 22 are preferably constructed of cast aluminum. The support 22 is generally C-shaped, in overall configuration, and includes a central vertical portion 24 and a pair of identical horizontal portions 26 projecting in the same direction from polar ends 28 of the central vertical portion. The horizontal portions 26 function to support the work surface 16 on the legs 18 and the desk 10 from the floor.

Figure 3:
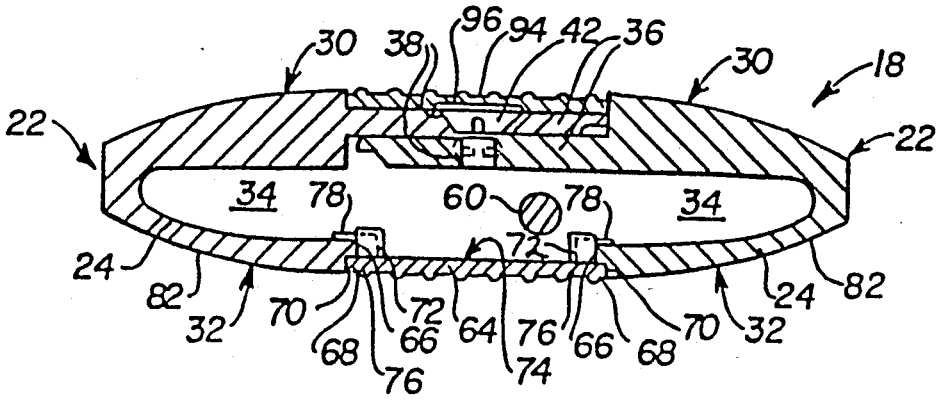
FIG. 3 is a cross-sectional view of a desk leg taken along lines 3—3 of FIG. 2.
Figure 4:
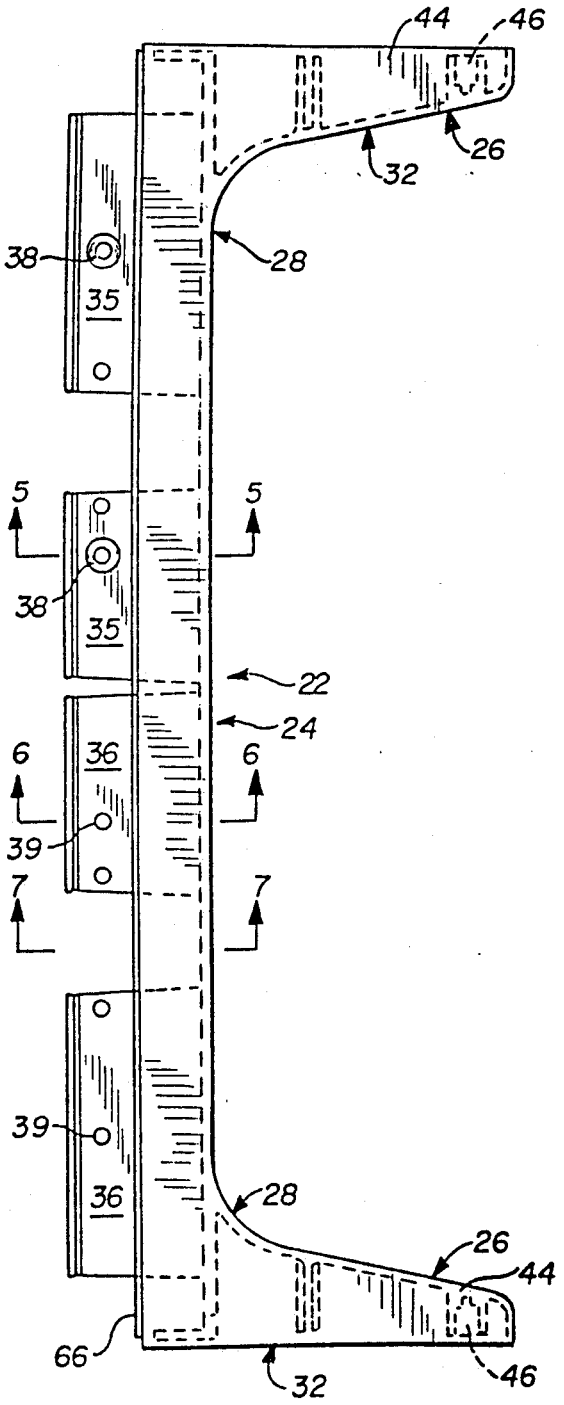
FIG. 4 is a side elevational view of a leg support of the desk leg.
Figure 7:
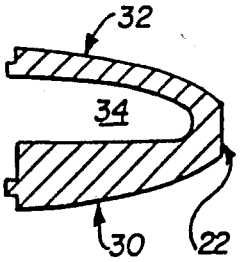
FIG. 7 is a cross-sectional view of the leg support taken along line 7—7 of FIG. 4.

As shown in FIGS. 3, 4 and 7 which illustrate a sectional view of the front and rear supports 22 forming the leg 18 illustrated in FIG. 2, a side elevational view of a support, and a sectional view of the vertical portion 24 of the support, respectively, the support is substantially U-shaped, in cross section, along substantially the full length of the vertical and horizontal portions 24, 26 of the support. The support 22 further includes an inner wall 30 and an outer wall 32, with a space 34 between the walls. In addition, at least one pair of vertically spaced plates 35, 36, (two pairs being illustrated) on the inner wall 30 of the vertical portion 24 of the support 22 extend in a direction opposite from that of the horizontal portions 26 of the support. One plate 35 of the pair has extending therethrough an opening 38. The other plate 36 has extending therethrough a threaded opening 39. The plates 35, 36 and their holes 38, 39 function to mount a pair of supports 22 together in inverted, opposing, back-to-back relationship as discussed below in detail. The plates 35, 36 are preferably formed integral with the support 22 when the same is cast.

Figure 5:
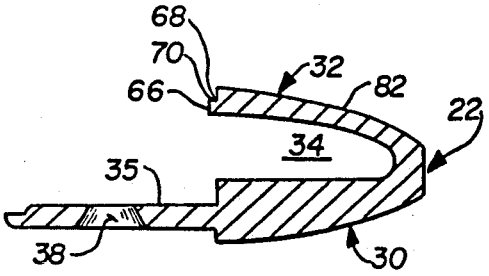
FIG. 5 is a cross-sectional view of the leg support taken along lines 5—5 of FIG. 4.
Figure 6:
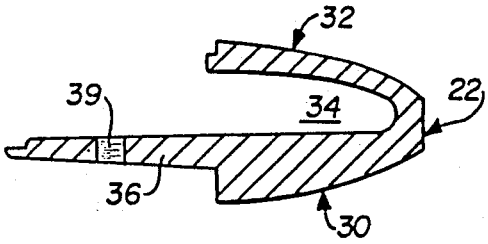
FIG. 6 is a cross-sectional view of the leg support taken along lines 6—6 of FIG. 4.

As shown most clearly in FIGS. 5 and 6, which illustrate sectional views of the vertical portion 24 of the support 22 illustrated in FIG. 4 at the loci of the plates 35, 36, the pair of plates are positioned in horizontally staggered vertical planes. In addition, because the horizontally-extending portions 26 of the support 22 are identical, a pair of supports can be combined to form a leg 18 of the desk 10 by merely positioning the supports in inverted relationship such that the spaces 34 of the supports face one another. In such position, the pair plates 35, 36 of the one support 22 engage and overlap with the pair of plates 35, 36 of the other support 22, and the holes 38, 39 in the plates align. More specifically, the plate 35 of one support 22 overlaps and engages in a complementary fashion the plate 36 of the other support. In the same manner, the plate 36 of the one support is complementary with the plate 35 of the other support. And the pairs of plates 35, 36 of the supports fit together in such complementary manner only when the supports are positioned in inverted opposing relationship. As shown in FIG. 3, the supports 22 can then be secured together in inverted back-to-back opposing relationship by screws 42 in registry with and threadably engaging the aligned pairs of openings 38, 39.

By using identical supports 22 to form legs 18 of the desks 10, tooling costs can be significantly reduced over the situation where a pair of differing dedicated "front" and "rear" supports are used to form a desk leg. In addition, inventory problems are likewise reduced when identical supports 22 are employed to form a leg 18 of the desk 10. It will be seen, however, that once a pair of supports 22 are secured together in the above described manner and are thereafter prepared for supporting the top 16, the supports become dedicated to "front" and "rear" positioning with respect to the leg 18 formed by the supports.

Each of the identical horizontal portions 26 of the support 22 include on ends 44 thereof bosses 46, preferably formed integral with the support 22 when the same is cast. Once the supports are mounted together as described above, the horizontal portions 26 are prepared for mounting the top 16 to an upper portion 48 of the leg 18 and floor glides 50 to a lower portion 52 of the leg. The bosses 46 on the upper portion 48 of a leg are drilled through, forming bores (not shown) extending through the bosses. Screws (not shown) set in registry with the bores and threaded into holes (not shown) in the top 16 mount the leg 18 to the top. It should be noted that the leg 18 can be so mounted to either side 44 of the top 16 so long as the inner walls 30 and the plates 36 thereof of the supports 22 are positioned inwardly of the outer walls 32 of the supports. At this point in the assembly of the desk, the supports 22 forming the leg 18 become dedicated as "front" and "rear" supports of the leg. Thereafter, the bosses 46 on the lower portion 52 of the leg 18 are drilled and tapped for threadably receiving the floor glides 50.

Figure 8:
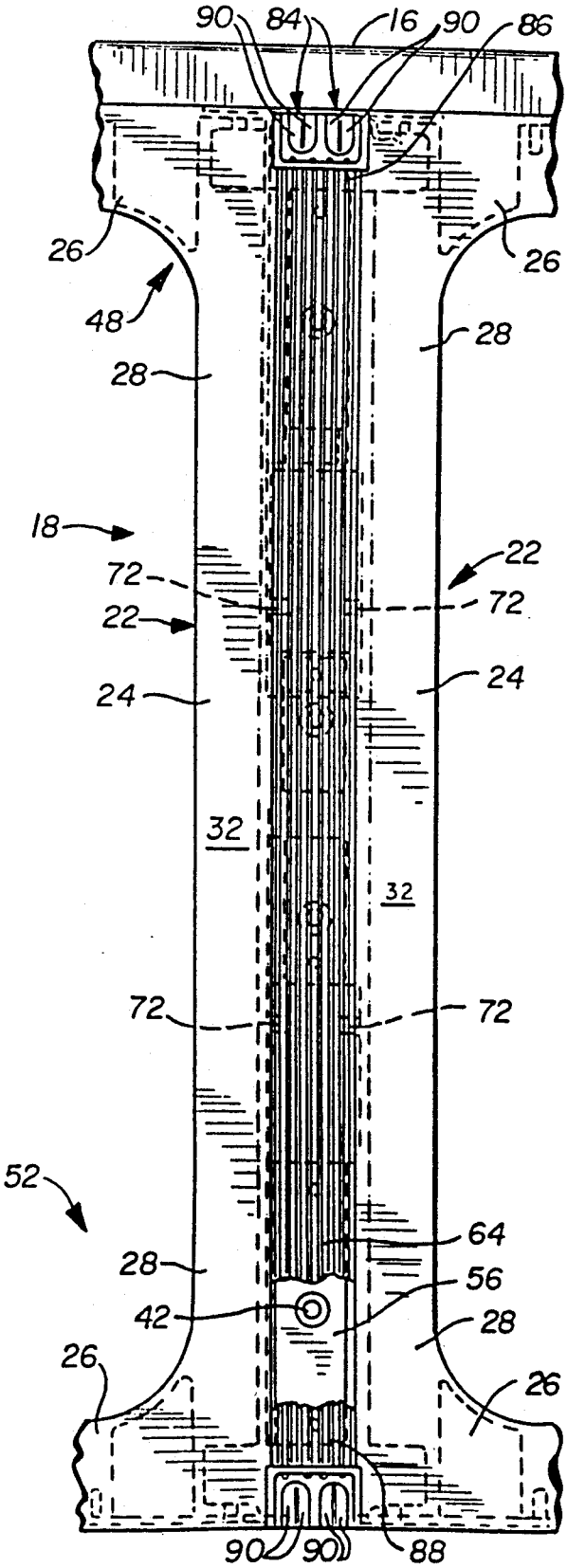
FIG. 8 is an enlarged side elevational view of the desk leg.

As illustrated in FIGS. 3 and 8, when the supports 22 are mounted together in the manner described above, a leg channel 56 (hereinafter some times, referred to as the "first channel") is formed by opposing spaces 34 defined by inner and outer walls 30, 32 of the supports and the complementary pairs of overlapping plates 35, 36 thereof. The leg channel 56 is open at an outer side 58 thereof and is adapted to receive electrical and communication wiring 60 of work accessories, such as a telephone 62 and/or a desk lamp 105 supported by the desk top 16.

An outer leg cover 64 is removably mounted to the leg 18 over the open outer side 58 of the leg channel 56 to completely enclose the wiring 60 positioned therein. The outer leg cover 64 is mounted to the leg 18 in snap-fit relationship. To this end, as best shown in FIG. 3, opposing edges 66 of the outer walls 32 of the supports 22 are provided with right angular detent notches 68 running along substantially the full length of outer walls 70 of the edges 66. In addition, the outer leg cover 64 is provided with a pair of elongated tabs 72 extending inwardly from rear surface 74 of the cover and along substantially the full length of both longitudinal sides 76 of the cover. The outer leg cover 64 further includes a pair of flexible stops 78 on and normal to the tabs 72. The outer leg cover 64 can be mounted to the leg 18 over the desk leg channel 56 by inserting a longitudinal end 76 of the cover in the leg channel 56 such that the stop 78 thereof is positioned behind the outer wall 32 of the rear support 22 of the leg and the tab 72 is positioned directly adjacent the edge 66 of the support. Subsequently, the other longitudinal end 76 of the outer leg cover 64 is moved rearwardly such that its respective stop resiliently engages the edge 66 of the front support 22 of the leg 18 and comes to rest behind the outer wall 32 of the support and main body portion 80 of the cover is positioned in the detent notches 68 and substantially flush with outer surfaces 82 of the outer walls 32 of the supports.

The outer leg cover 64 is also provided with a pair of first openings 84 on upper and lower terminal ends 86, 88 of the cover, each opening being closed off by two pairs of resilient doors 90 (hereinafter sometimes referred to as "closure means"). The openings 84 permit access of opposite ends 92 of the wiring 60 to the leg channel, one end 92 of the wiring leading to an electrical receptacle (not shown) and the other end 92 leading to a work accessory 62 supported on the desk top 16.

The outer leg cover 64 is preferably made of injected molded plastic, such as styrene. The resilient doors 86 are preferably formed of resilient polyvinyl chloride.

The desk 10 described above is therefore provided with wire management capability heretofore not provided in conventional freestanding desks, wherein wiring for work accessories supported on the desk dangles freely from the sides, front and/or back of the desk. The leg channels 56 and covers 64 thereof on both sides of the desk 10 house wiring 60 in legs 18 of the desk and therefore position the wiring where it cannot pose a potential danger to workers. In addition, because the wiring 60 is hidden from view, the wiring does not detract from the aesthetic attractiveness of the desk and thus the work environment as a whole.

It should be noted that just as the outer portions of the legs 18 can have covers 64 mounted thereto over open outer sides 58 of the leg channels 56, inner walls 30 of the legs can have mounted thereto inner leg covers 94 as illustrated in FIG. 3. The inner leg covers 94 cover the overlapping plates 35, 36 of the supports 22. Specifically, the covers 94 can be provided with a series of openings 96 aligned with certain of the aligned openings 38, 39 of the overlapping plates 35, 36. The screws 42 extend through the aligned openings 38, 39 to mount the plates 35, 36 together in overlapping relationship and to mount the covers 94 over the plates. Alternatively, the inner leg covers 94 can have formed thereon inwardly projecting buttons (not shown) adapted to register with holes (not shown) in the overlapping plates 35, 36 in snap-fit engagement with the same to mount the covers 94 to the legs 18.

Figure 9A:
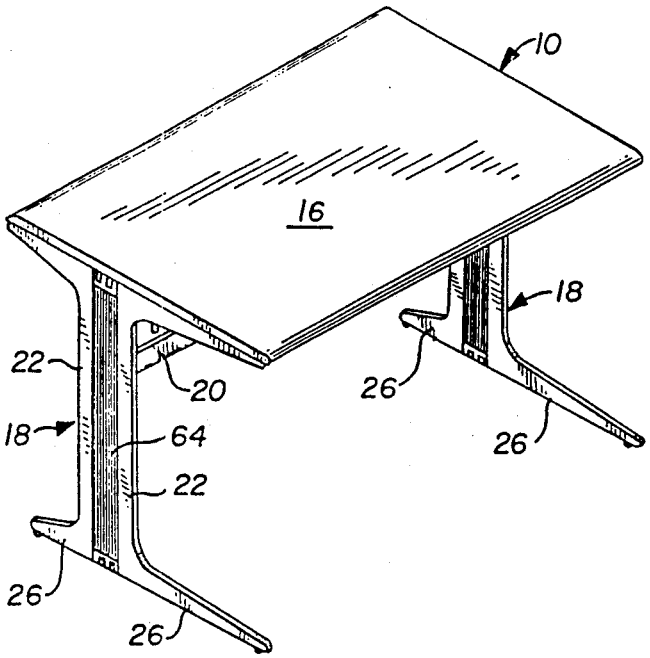
FIGS. 9A and 9B illustrate front perspective and side elevational views of an alternative embodiment of the desk.
Figure 9B:
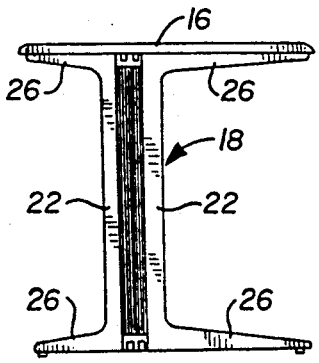
Figure 10A:
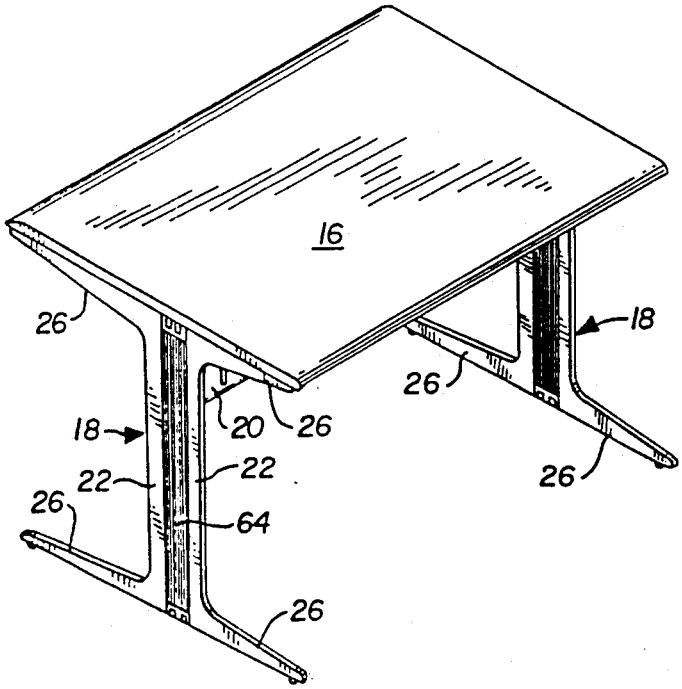
FIGS. 10A and 10B illustrate rear perspective and side elevational views of another embodiment of the desk.
Figure 10B:
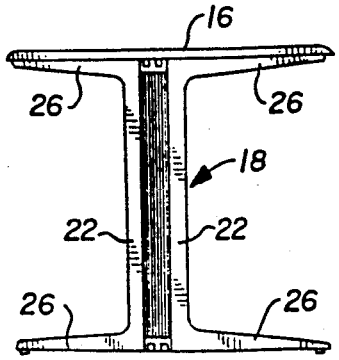
Figure 11A:
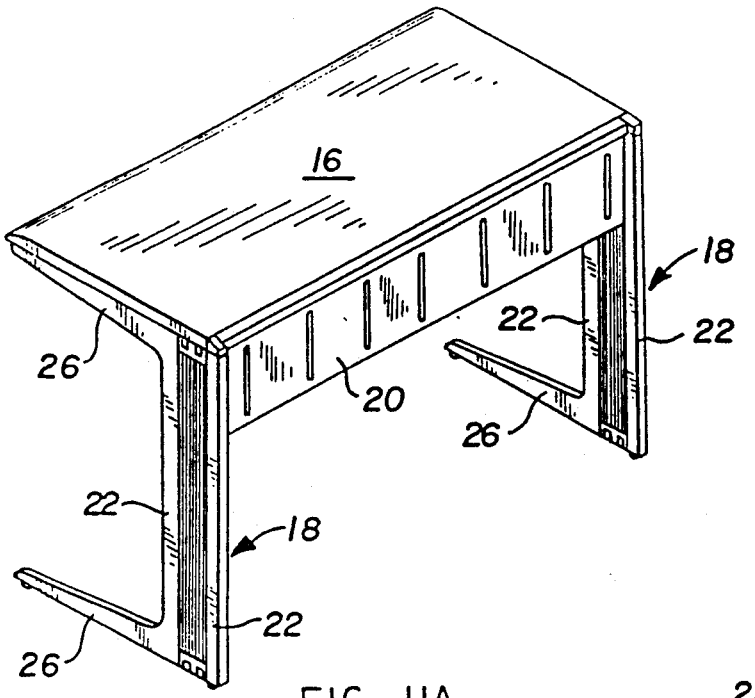
FIGS. 11A and 11B illustrate rear perspective and side elevational views of an additional embodiment of the desk.
Figure 11B:
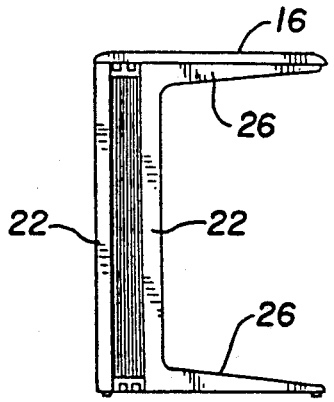

As shown in FIGS. 9–11, the invention contemplates desks 10 of various size to accommodate particular needs of workers in the work environment. The desks 10 illustrated in these figures represent three of many other possible embodiments envisioned by the invention; however, only three are shown for convenience in illustration. These desks 10 are substantially identical to that heretofore discussed, the only difference being in the size of the horizontal portions 26 of the leg supports 22. As can be seen, with respect to the supports 22 as assembled to form legs 18 of the desks 10, preferably each desk is provided with a pair of relatively large front leg supports 22, the user's side of the desk being designated as the front side thereof, mounted to rear supports 22 of any size. By this design, a worker is provided with sufficient space underneath the desk top 16 to rest his/her legs.

Figure 12:
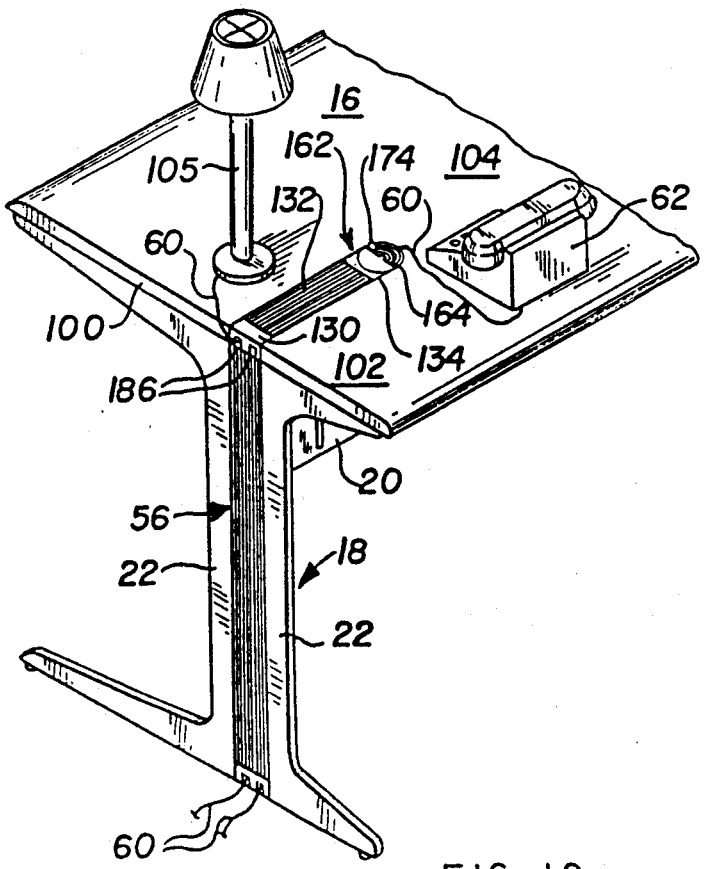
FIG. 12 is a fragmentary rear perspective view of a further embodiment of the desk having leg and work surface channels.

As shown in FIG. 12, the desk 10 can also be provided with a desk top channel 98 (hereinafter sometimes referred to as the "second channel") within the desk top 16. The desk top channel 98 functions like the leg channel 56; that is, to manage wiring 60 of electronic work accessories, such as a telephone 62, positioned on the desk top 16. Preferably, the desk 10 includes a pair of desk top channels extending inwardly from transverse end edges 100 of the top 16 directly adjacent and above the leg channels 56. It is further preferred that the desk top channels 98 be in registry with the leg channels 56 so that on each side 102 of the desk 10 there is provided a continuous channel (not specifically referenced in the figures) extending up the desk legs 18 and inwardly therefrom with respect to the desk top 16 a predetermined distance, formed by the first and second channels 56, 98, and for managing wiring of the work accessories. In this manner, for example, the telephone 62 can be placed on the desk top 16 at a central portion 104 thereof and the wiring 60 of the telephone can be concealed from view and out of position of interference with work being conducted on the desk top.

Figure 13:
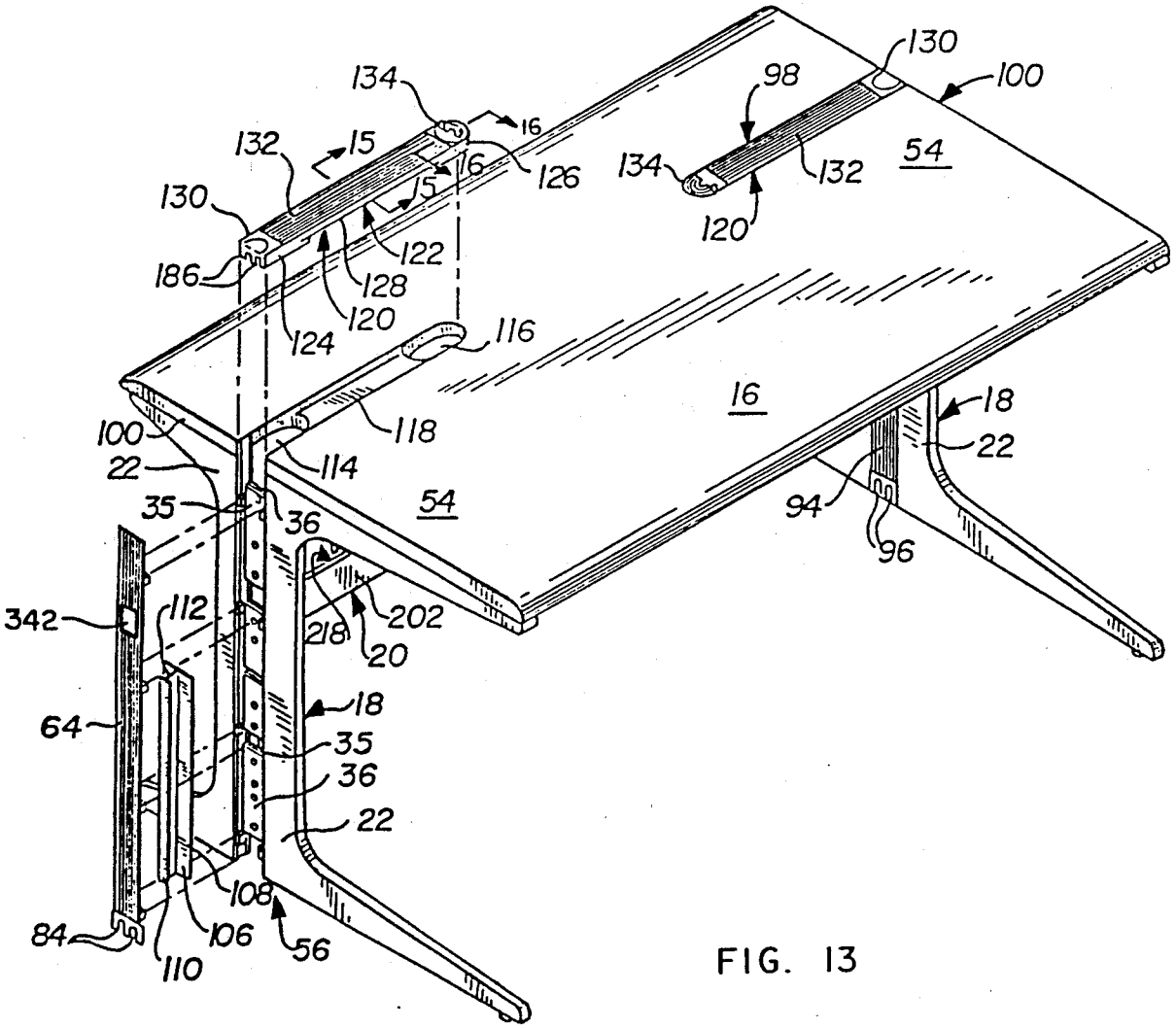
FIG. 13 is a partially exploded fragmentary front perspective view of the desk illustrated in FIG. 12.

As shown in FIG. 13, each leg channel 56 can be provided with a leg wire organizer 106 (hereinafter sometimes referred to as the "first wire organizer means") for segregating communication and power wiring 60. The wire organizer 106 is an elongated, substantially I-shaped, in cross-section, member having inner and outer parallel walls 108, 110 and a center web 112 positioned between and perpendicular to the walls. The walls 108, 110 are of a width to fit within the leg channel 56 and when so positioned function to divide the same into longitudinal halves to segregate the communication and power wiring 60. To securely position the wire organizer 106 within the leg channel 56, double-sided foam tape (not shown) is mounted to the rear surface (not shown) of the inner wall 108 of the organizer 106. The tape functions to hold the organizer 106 against the overlapping plates 36 of the leg supports 22. The organizer 106 is preferably formed of extruded plastic, specifically, polyvinyl chloride. As may be surmised, when positioned in the leg cable port 56, the wire organizer is hidden from view by the outer leg cover 64.

Referring again specifically to FIG. 13, to accommodate the desk top channel 98, the desk top 16 is provided, on each side 54 thereof, with an outer half-oval slot 114 extending through and inwardly from the transverse end edge 100 of the top a predetermined distance, and an inner full-oval slot 116 extending through the top, linearly aligned with the half-oval slot and spaced inwardly therefrom a predetermined distance. The slots 114, 116 are connected by a depression 118 in the top (the slots and depression sometimes hereinafter referred to collectively as "slot means").

Figure 14:
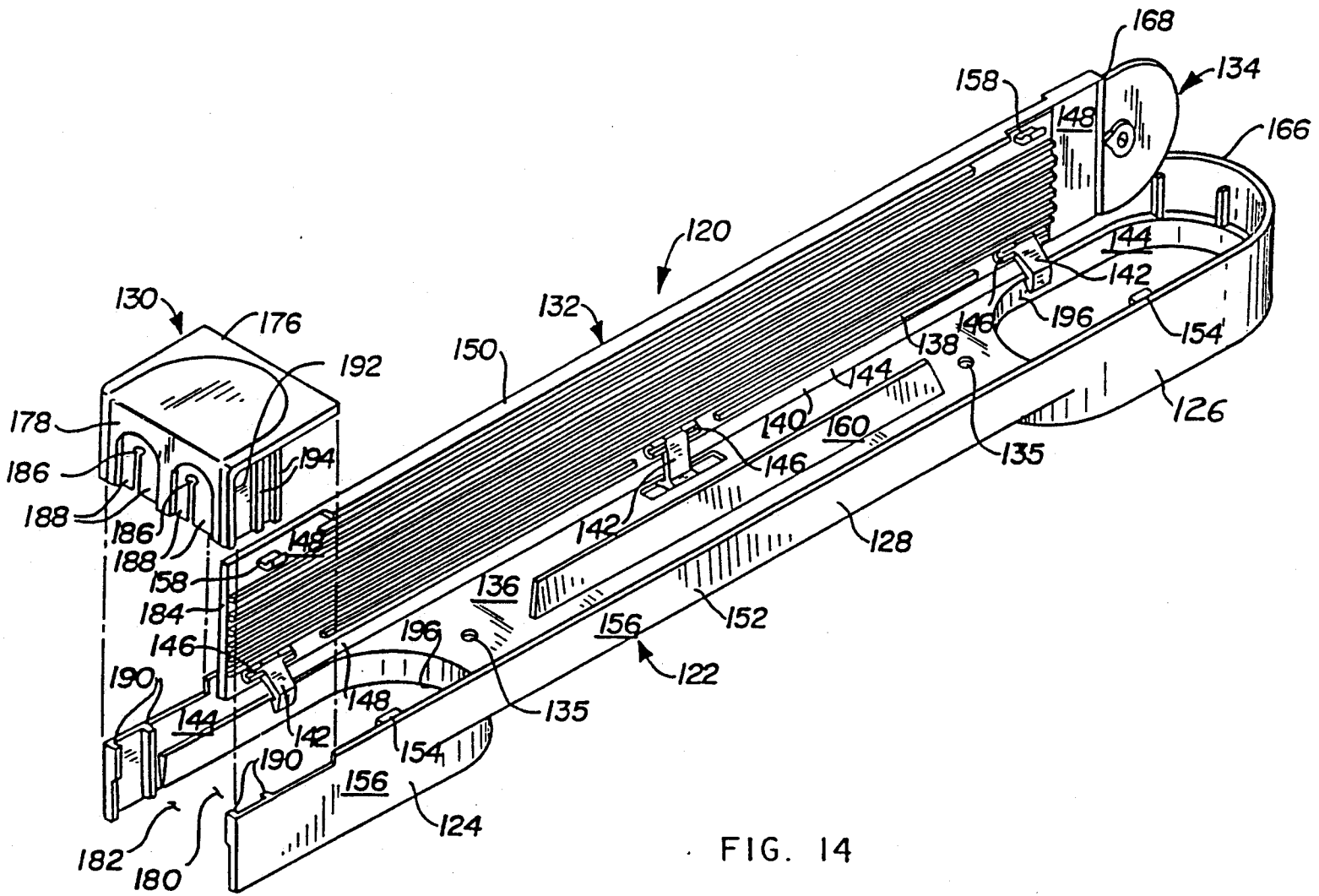
FIG. 14 is an enlarged perspective view of a wire manager assembly of the work surface channel.

A wire manager assembly 120, as best illustrated in FIG. 14, is set in substantially full registry with the slots 114, 116 and the depression 118 and includes a wire manager or base portion 122 having outer and inner deep portions 124, 126 in registry with the outer and inner slots 114, 116, respectively, and a central shallow portion 128 in registry with the depression 118. The wire manager 122 is preferably formed of injection-molded plastic. The assembly 120 further includes an outer end cap 130 (hereinafter sometimes referred to as the "outer cover means") removably mounted to the outer deep portion 124 of the wire manager, a central desk top channel cover 132 hingeably mounted to the wire manager 122 and a wire access cover 134 (hereinafter sometimes referred to as the "inner cover means") movably mounted to the desk top channel 132 above the inner deep portion 126 of the wire manager.

The work surface cable port wire manager assembly 120 is securely mounted to the desk top 16 and in registry with the slots 114, 116 and the depression 118 by a plurality of screws (not shown) extending through an equal number of holes 135 in a bottom wall 136 of the shallow central portion 128 of the wire manager 122 and into the top 16 at the depression 118 of the same.

Figure 15:
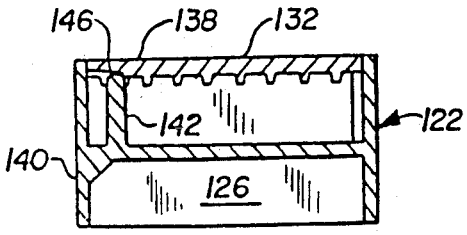
FIG. 15 is a cross-sectional view of the wire manager assembly taken along lines 15—15 of FIG. 13.

The desk top channel cover 132 is hingeably mounted to the wire manager 122 at first longitudinal sides 138, 140 of the cover 132 and the wire manager 122, respectively. To this end, the wire manager 122 has, as shown in FIGS. 14 and 15, a plurality of T-shaped hinge pins 142 spaced along a first inner side wall 144 of the wire manager, and the desk top channel cover 132 includes a plurality of correspondingly spaced knuckles 146 on an inner surface 148 and at the first longitudinal side 138 of the cover. The knuckles 146 are set in rotatable snap-fit engagement with the hinge pins 142 to hingeably mount the second cover 132 to the wire manager 122. The desk top channel cover 132 is also preferably formed of injection-molded plastic. The hingeable connection between the cover 132 and the wire manager 122 permits convenient access to the desk top channel 98 for placement of the wiring 60 therein.

As illustrated in FIG. 14, to prevent inadvertent opening of the cover 132 with respect to the wire manager 122, the cover is provided with a snap-fit connection at second longitudinal sides 150, 152 of the cover and the wire manager, respectively. Specifically, the wire manager 122 is provided with a number of retainers 154 formed integral with a second inner side wall 156 of the wire manager directly opposite the hinge pins 142, and the cover 132 includes an equal number of correspondingly positioned resilient flanges 158 on the inner surface 148 of the cover and at the second longitudinal side 150 of the same. In the closed position of the cover 132, the resilient flanges 158 thereof engage the retainers 154 of the wire manager 122 in snap-fit relationship to maintain the cover in closed position over the desk top channel 98.

To segregate the communication and power wiring 60 in the desk top channel 98, the wire manager 122 is provided with a desk top wire organizer 160 (hereinafter sometimes referred to as the "second wire organizer means") formed integral with and extending upwardly from the bottom wall 136 of the shallow central portion 128 of the wire manager. Together with the leg wire organizer 106 of the leg channel 56, segregation of the wiring 60 can be accomplished substantially along the full length of the leg and desk top channels 56, 98, thereby providing the desk 10 with optimum wire management capability.

Figure 16:
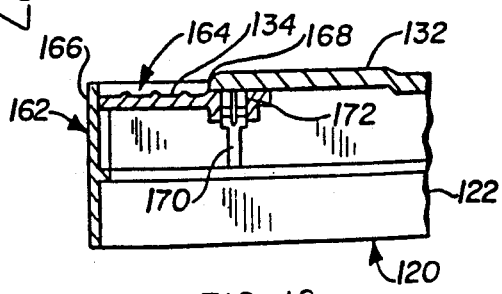
FIG. 16 is a cross-sectional view of the wire manager assembly taken along lines 16—16 of FIG. 13.

As shown in FIGS. 12, 14 and 16, to permit access to the wiring 60 at an inner end 162 of the wire manager assembly 120 and at a central portion 104 of the desk top 16, the assembly 120 is provided with a half-circular opening 164 between an inner rounded end 166 of the wire manager 122 and an inner end 168 of the desk top channel cover 132. The opening 164 can be closed off with the wire access cover 134 which is movably mounted for rotational movement to the desk top cover 132. To this end, as shown in FIG. 16, the desk top cover 132 is provided with a downwardly-depending pin 170 on the inner end 168 thereof and the wire access cover 134 includes an eccentric hole 172 in registry with the pin 170 below the cover 132. The wire access cover 134 is rotatable about an angle of approximately 180° between fully open and closed positions. However, during use of the desk top channel 98, the wire access cover 134 is generally set in a partially open position to accommodate the wiring 60 passing therethrough. The wire access cover 134 includes an upstanding handle 174 for manually facilitating rotational movement of the cover 134. Like the wire manager 122 and the cover 132, the wire access cover 134 is preferably formed of injection-molded plastic.

The end cap 130 of the assembly 120 is an L-shaped member having horizontal and vertical legs 176, 178 adapted to cover square opening 180 formed between an outer open end 182 of the wire manager 122 and an outer end 184 of the desk top cover 132. The vertical leg 178 of the end cap 130 includes a pair of horizontally spaced holes 186, each covered by a pair of resilient doors 188 which permit desk-side access to the leg and desk top channels 56, 98. It should be noted that provision of the holes 186 and the doors 188 covering the same can necessitate elimination of the openings 84 on the upper end 86 of the outer leg cover 64 It is desirable to provide the desk 10 with openings 84 on the upper portions 48 of the legs 18 so that work accessories such as the telephone 62 and a desk lamp 105 can be positioned on both side and central portions 102, 104 of the desk top 16, with the wiring 62 of the work accessories substantially hidden from view and out of position of interference with a worker's activities at the desk 10.

The end cap 130 is slidably mounted for vertical movement to the wire manager 122. To this end, the wire manager 122 has formed on the first and second inner side walls 144, 156 of the same vertical ribs 190, and the end cap 130 has on inset side walls 192 thereof channels 194 in which the ribs register to slidably mount the end cap to the wire manager. Removability of the end cap 130 with respect to the wire manager 122 provides convenient access to the leg channel 56 and the overlapping plates 36 of the legs 18 for purposes discussed below in detail.

As can be seen in FIGS. 14, the outer and inner deep portions 124, 126 of the wire manager 122 have open bottom ends 196 in full registry with the outer half-oval and inner full-oval slots 114, 116 of the desk top 16. By this design, the wiring 60 of the work accessories 62, 105 positioned on the side and central portions 54, 104 of the desk top 16 can be channeled from the work accessories, into the desk top channels 98, through the open bottom ends 196 of the wire manager 122, through the slots 114, 116 and to an electrical receptacle (not shown) located beneath the top 16. Use of such wiring pathways may be preferable to full use of the leg and desk top channels 56, 98.

In a preferred embodiment, the apron 20 and the leg channels 56 are also employed to facilitate management of the wiring 62 channeled through the outer and inner slots 114, 116.

Figure 17:
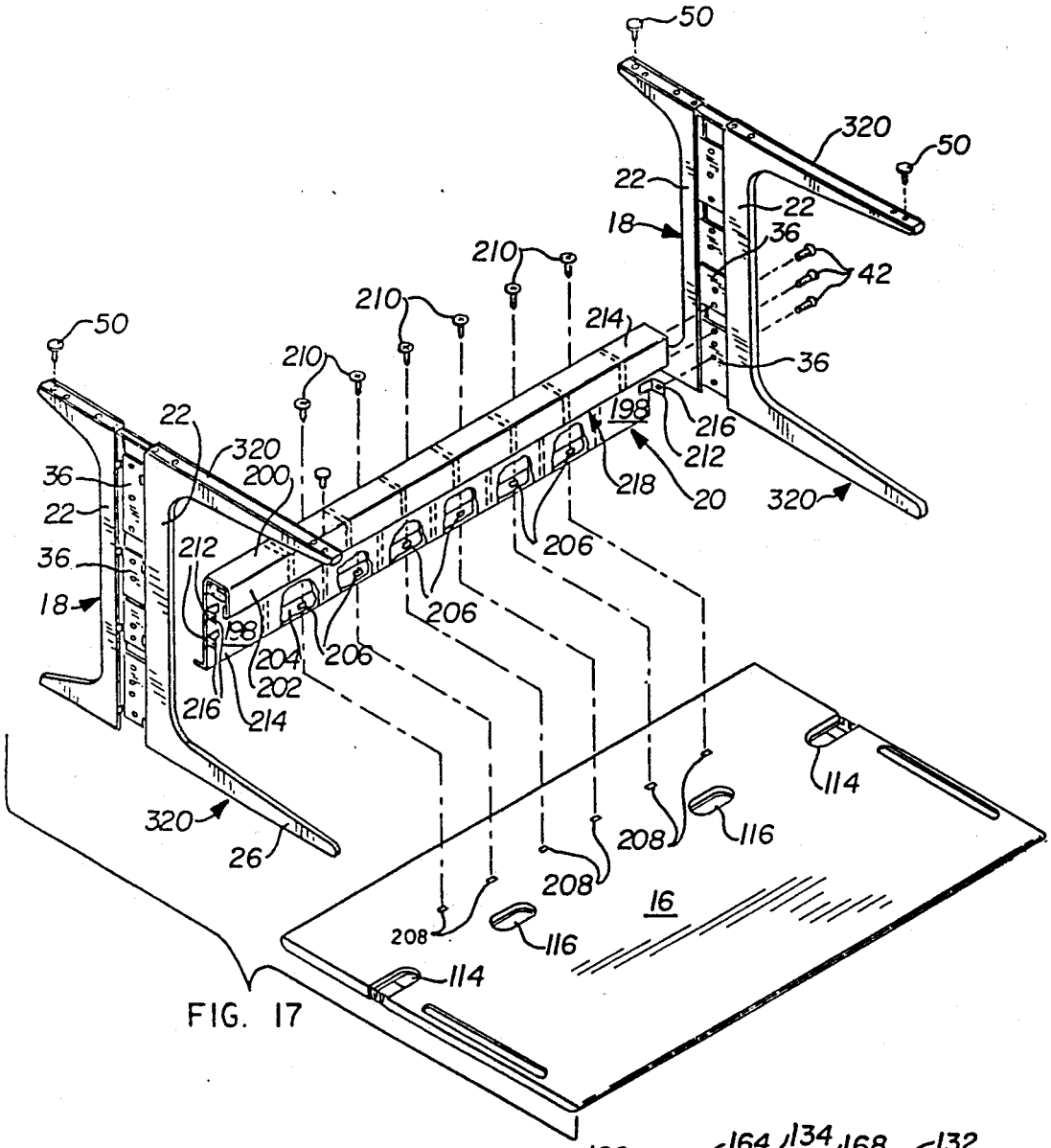
FIG. 17 is a bottom, front exploded perspective view of the desk illustrated in FIG. 12.

As illustrated in FIG. 17, the apron 20 is a substantially J-shaped, in cross-section, member having a long vertical leg 198, a short horizontal leg 200 extending forwardly from the long vertical leg and a short vertical leg 202 extending upwardly from the short horizontal leg and parallel with the long vertical leg in spaced relationship thereto. The privacy panel function of the apron 20 heretofore discussed is primarily performed by the long vertical leg 198.

The apron 20 is securely mounted to and below the desk top 16. To this end, the apron further includes a horizontal mounting flange 204 extending along the full length of the long vertical leg 198 of the apron and having a series of spaced holes 206 through the flange 204. The desk top 16 includes an equal number of holes 208 therein aligned with the holes 206 in the flange 204. A plurality of screws 210 are set in registry with the aligned holes 206, 208 and engage the desk top 16 to mount the apron 20 to the top.

To ensure a secure mounting of the apron 20 to the desk 10, the apron is also securely mounted to and between the legs 18 and is thus provided with a plurality of mounting L-flanges 212 secured to the long vertical leg 198 of the apron at each transverse end 214 of the same. The L-flanges 212 have openings 216 aligned with certain of the aligned holes 38, 39 of the overlapping plates 35, 36 of the leg supports 20. The screws 42 extend through the aligned openings 216 and holes 38, 39 to securely mount the apron 20 to and between the legs 18. It may be surmised that in such position, the apron 20 provides for lateral stability of the desk 10 by limiting lateral movement of the legs 18.

The apron 20 not only functions as a modesty or privacy panel as heretofore discussed, but it also has wire management capability. Specifically, a channel 218 (hereinafter sometimes referred to as the "third channel") is formed between the long and short vertical and short horizontal legs 198, 200, 202 of the apron 20 and extends along the full length thereof. The channel 218 is adapted to receive the wiring 60 channeled through the outer and inner slots 114, 116 as described above. The wiring 60 can then be routed down through the leg channels 56.

As indicated, not only can the leg channels 56 function to manage the wiring 60 channeled through the wire manager 122 of the wire manager assembly 120, but they can also accept wiring channeled through the outer and inner slots 114, 116 of the desk top 16 and the channel 218 of the apron 20. As stated above, the legs 18 have mounted to the inner walls 30 thereof the inner leg covers 94. The covers 94 extend from the lower portions 52 of the legs to positions thereon where the apron 20 is mounted to the legs. Thus, the wiring 60 in the channel 218 can be fed between pairs of overlapping plates 35, 36 of the leg supports 22 of a leg 18 and into a leg channel 56. The wiring can then be channeled to the lower portions 52 of the legs 18, inwardly past the lowermost pair of overlapping plates 35, 36, out openings 84 in the inner leg covers 94 and to an electrical receptacle (not shown) located beneath the desk 10.

As stated above, the end caps 130 of the desk top assemblies 120 are removably mounted to the wire managers 122 of the same to enable exposure of square openings 180 and permit convenient access to the leg channels 56 and the pairs of overlapping leg support plates 35, 36 positioned therein. Exposure of the plates 35, 36 is desirable for they provide a convenient point for attachment of work tools as hereinafter discussed.

Figure 18:
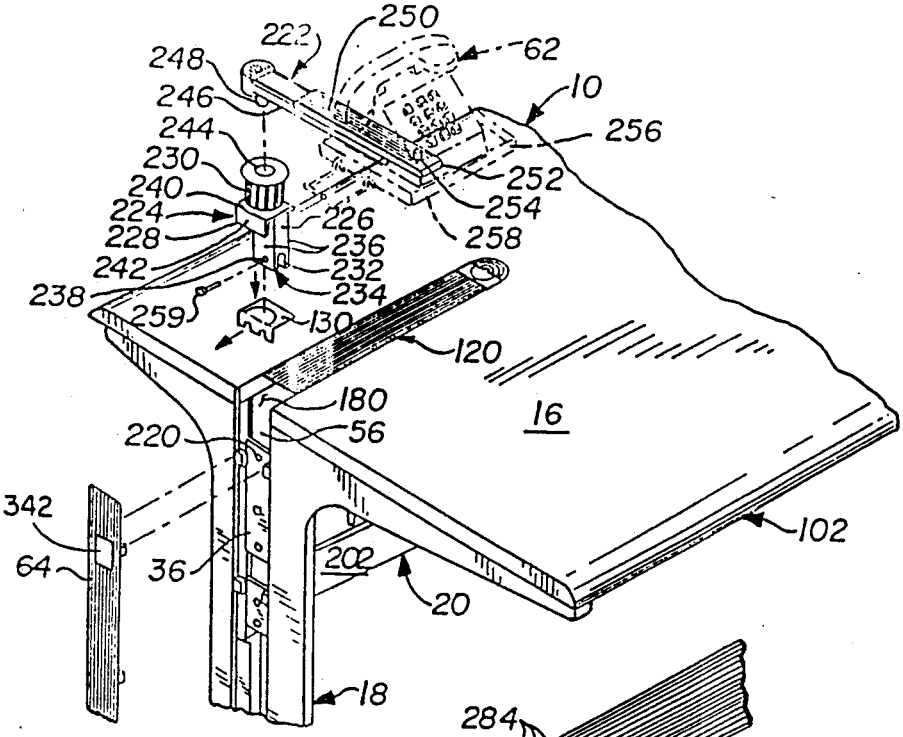
FIG. 18 is an exploded fragmentary front perspective view of the desk and a work accessory support armature mounted thereto.

As shown in FIG. 18, referring to one side 102 of the desk 10, the uppermost pair of overlapping plates 35, 36 can be provided with a pair of aligned apertures 220 for mounting to the desk a work accessory support, such as an armature 222, for supporting a work accessory such as the telephone 62. The armature 222 is mounted to the desk by a tool bracket 224 (hereinafter sometimes referred to as "attachment means") having a lower downwardly-depending mounting part 226, a central cap 228 and an upper mounting part 230. The lower mounting part 226 includes a slot 232 extending upwardly from base 234 of the lower part 226 so as to form a pair of spaced legs 236. A pair of aligned orifices 238 extend through the legs 236 and are adapted to align with the aligned apertures 220 of the overlapping plates 36. The central cap 228 includes a horizontal part 240 and a vertical part 242, the lower mounting part 226 depending downwardly from the horizontal part 240 of the cap 228. The upper mounting part 230 of the tool bracket 224 is also mounted to the horizontal part 240 of the cap 228. The upper part 230 is a cylindrical member having a socket 244 formed therein. The armature 222 is adapted to mount to the upper part 230 of the tool bracket 224, is extensible along its longitudinal axis and comprises a base portion 246 having at one end thereof a downwardly-depending first pin 248 and an upper portion 250 slidably mounted to the base portion 46 along a longitudinal axis of the same by a spleen- and-groove connection. The extensible portion 250 has on an outer end 252 thereof an upwardly-projecting second pin 254. A work accessory support tray 256 for supporting, for example, the telephone 62, is adapted to rotatably mount to the outer end 252 of the armature 222 and to this end includes a socket (not shown) formed in a bottom wall 258 thereof and for registry with the second pin 254 of the armature.

To mount the armature 222 to the desk 10 and the work accessory support tray 256 to the armature, the end cap 130 is first removed from slidable engagement with the wire manager 122, thereby exposing the square opening 180 and the overlapping support leg plates 35, 36 in the leg channel 56. The tool bracket 224 is thereafter mounted to the desk 10 by positioning the lower mounting part 226 of the bracket 224 in the leg channel 56 and in slidable engagement with the uppermost pair of overlapping plates 35, 36 such that the spaced legs 236 of the lower mounting part 226 sandwich the overlapping plates 35, 36 and the orifices 238 align with aligned apertures 220 in the plates. A screw 259 is then set in registry with the aligned orifices 238 and apertures 220 to mount the tool bracket 224 to the overlapping plates 35, 36. In this position of the tool bracket 224, the horizontal and vertical parts 240, 242 of the central cap 228 of the tool bracket cover the square opening 180 as did the end cap 130 first removed as described above. It may be surmised that the end cap 130, after the same has been removed, can be placed in storage until it is required to again cover opening 180 after the tool bracket 224 is removed from its mounting to the overlapping plates 35, 36. Subsequently, the armature 222 is rotatably mounted to the tool bracket 224 by setting the first pin 248 of the armature in slidable registry with the socket 244 of the upper mounting part 230 of the tool bracket. The work accessory support tray 256 is thereafter rotatably mounted to the outer end 252 of the armature 222 by setting the second pin 254 in slidable registry with the socket (not shown) of the tray. In this manner, the work accessory 62 supported above the desk 10 can be mounted to a position of convenient access thereto by a worker at the desk and in a position out of interference with the work when not in use.

It should be noted that the pair of orifices formed in said spaced legs 236 can be formed therein to align with the pair of aligned openings 38, 39 extending through the overlapping plates 35, 36 when the tool bracket 224 is mounted to the plates. In such case, the provision of the aligned apertures 220 in the plates 35, 36 would be unnecessary. The screw 42, in registry with the aligned orifices and openings, in such case, would function to both mount the leg supports 22 together and mount the tool bracket 224 to the supports.

It should also be noted that although one armature 222 has been shown mounted to the desk 10, that two of such work accessory support tools can be utilized due to the symmetry of the desk with respect to the leg and desk top channels 56, 98 as heretofore described.

Figure 19:
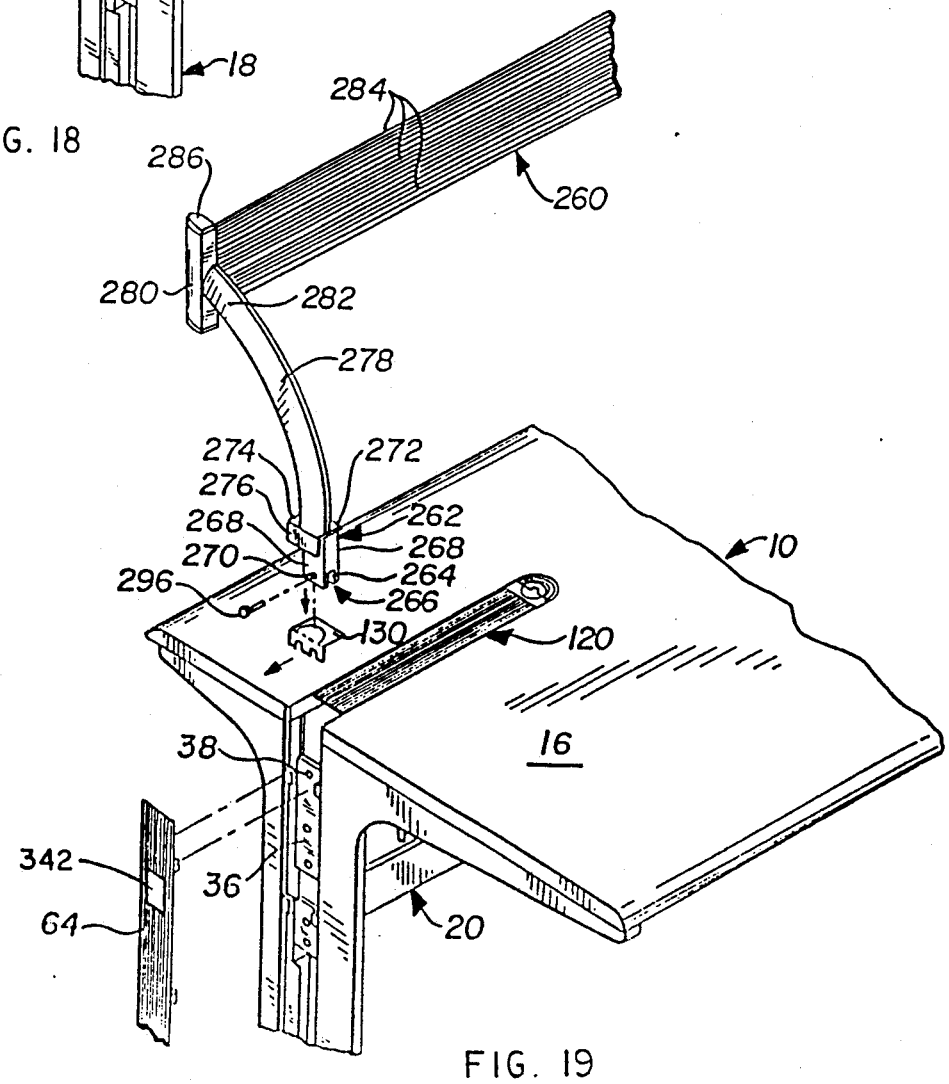
FIG. 19 is an exploded fragmentary front perspective view of the desk and work accessory support fence mounted thereto.
Figure 20:
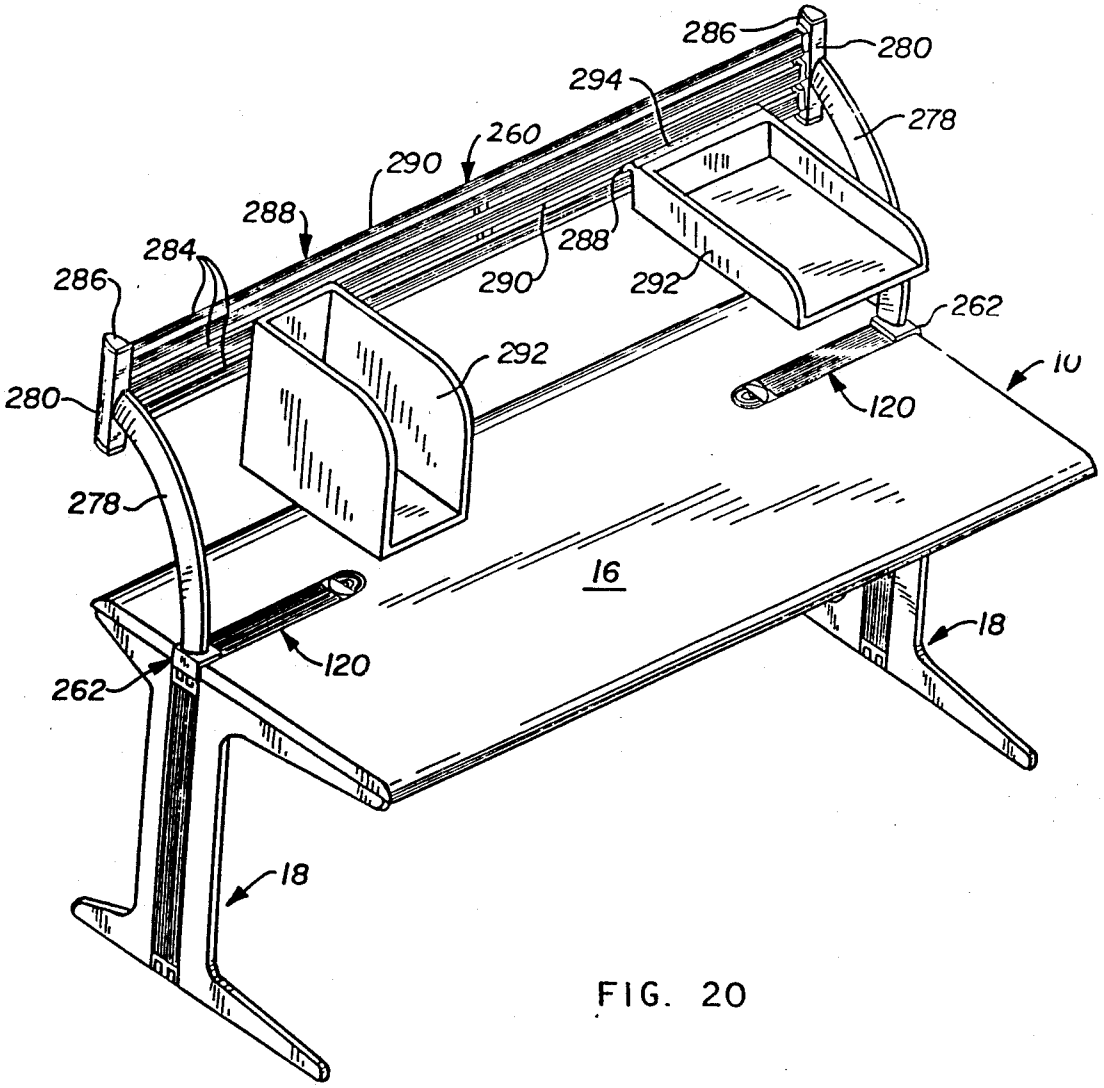
FIG. 20 is a front perspective view of the desk having the work accessory support fence mounted thereto and supporting work accessories.

Not only can the armature 222 be mounted to the desk 10 as described above, but a work tool support fence 260 can be similarly mounted to the desk as illustrated in FIGS. 19 and 20. The support fence 260 comprises, on each side thereof, a lower mounting portion 262 substantially identical in construction to the lower mounting part 226 of the tool bracket 224 and thus having a slot 264 extending upwardly from a base 266 of the lower mounting portion 262 to form spaced legs 268 having aligned orifices 270 therethrough. In addition, like the tool bracket 224, the fence 260 includes a cap 272 having horizontal and vertical parts 274, 276, the mounting portion 262 depending downwardly from the horizontal part 274. An arcuate-shaped rearwardly- and forwardly-extending arm 278 projects upwardly from the horizontal part 272. A vertically disposed rail mounting bracket 280 is mounted on the free end 282 of the arm 278.

Referring now to the support fence 260 as a whole, rather than just one side thereof, the fence further includes a series of elongated spaced horizontal work accessory support rails 284 mounted to and between opposing walls 286 of the spaced rail mounting brackets 280. Each rail 284 has extending along the full length thereof a channel 288 formed in an upper portion 290 of the rail. The rails 284 are adapted to support a variety of work tools such as paper trays 292 and the like in a horizontal cantilevered manner through rearwardly- and downwardly-extending hooks 294 on the trays, engageable with the rails and registrable with the channels 288 thereof.

Although not illustrated in the drawings, the work tool support fence 260 can have a pair of substantially straight/vertically extending arms, rather than the arcuate shaped arms 278 and vertically disposed rail mounting brackets 280. In such embodiment, the rails 284 are mounted to and between the straight vertically extending arms.

The tool support fence 260 is mounted to the desk 10 in substantially the same manner as the armature 222, namely, the end caps 130 on each side of the desk are removed from their respective wire managers and the lower mounting portions 262 of the fence are positioned in the leg channels 56 such that the two pairs of spaced legs 268 sandwich the pairs of overlapping plates 35, 36 and the aligned pairs of orifices 270 of the legs align with the pairs of aligned apertures 220 of the plates. Screws 296 are then set in registry with the aligned sets of orifices 270 and aperatures 220 to mount the support fence 260 to the desk.

It should be noted that the trays 292 can be supported on any of the vertically spaced rails 284 and at a continuum of horizontal locations along the rails. In this manner, the trays 292 can be set in a position above the desk 10 at a variety of convenient positions to accommodate the particular work needs of a worker, the physical characteristics of various workers and a variety of organizational schemes. By this design, the desk 10 is provided with work accessory management not heretofore available in a freestanding desk of conventional design.

Figure 21:
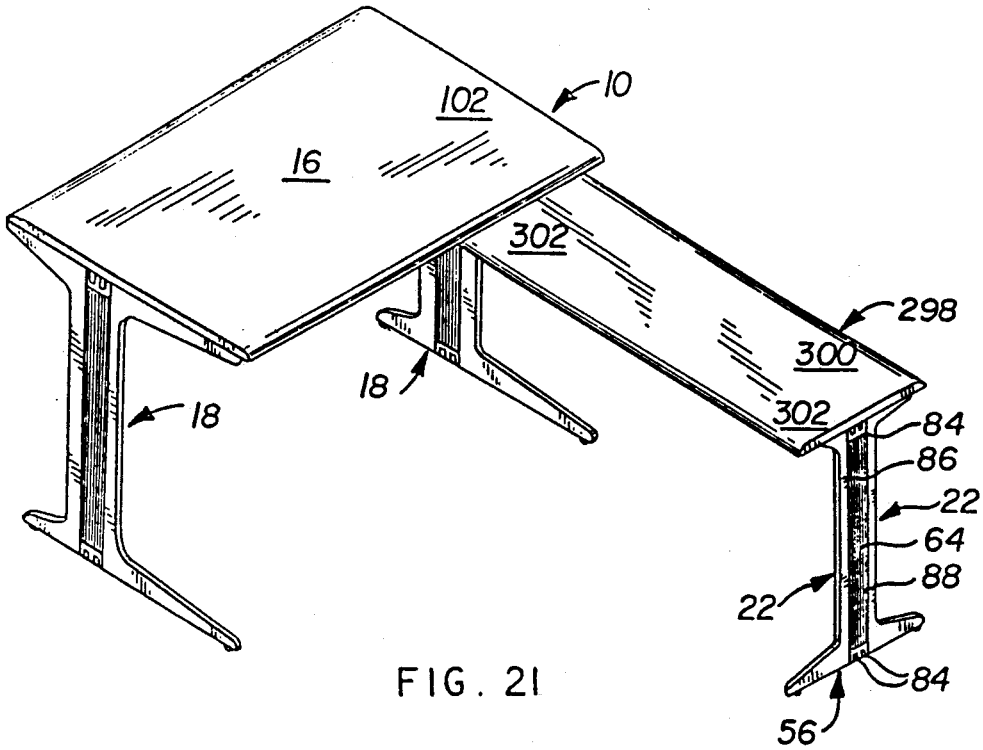
FIG. 21 is a front perspective view of the desk illustrated in FIG. 9 and having mounted thereto an L-return.

The desk 10 can be provided with additional work surface area by mounting to the desk an L-return 298 as illustrated in FIG. 21. Specifically, the L-return comprises a top 300 supported at a first transverse end 302 thereof by the desk top 16 and at the second transverse end 304 thereof by a pair of leg supports 22. Specifically, the first transverse end 302 of the top 300 is mounted perpendicular to the desk top 16 at a side 102 thereof directly below the top 16. The mounting between the desk top 16 and the top 300 can be achieved by any suitable mechanical means such as by brackets (not shown) securely mounted to and between the desk top 16 and the top 300. The second transverse end 302 of the top 300 is supported by a pair of relatively small identical leg supports 20 securely mounted together in back-to-back opposing relationship as heretofore described. Like the desk legs 18, the leg 18 formed by the supports 20 supporting the L-return is associated with a leg channel and a leg channel cover 64 having openings 84 in the upper and lower ends 86, 88 of the cover. In this manner, the L-return is adapted to manage wiring from work accessories, such as a typewriter (not shown), positioned on the L-return.

It should be noted that the provision of extensions of desk top by the mounting of auxiliary tops at right angles to desk tops is known. However, supporting the outer end of the auxiliary tops by pairs of leg supports 20 having formed therebetween a leg channel 56 with wire management capability complementary to desk wire management capability is not heretofore known.

Figure 22:
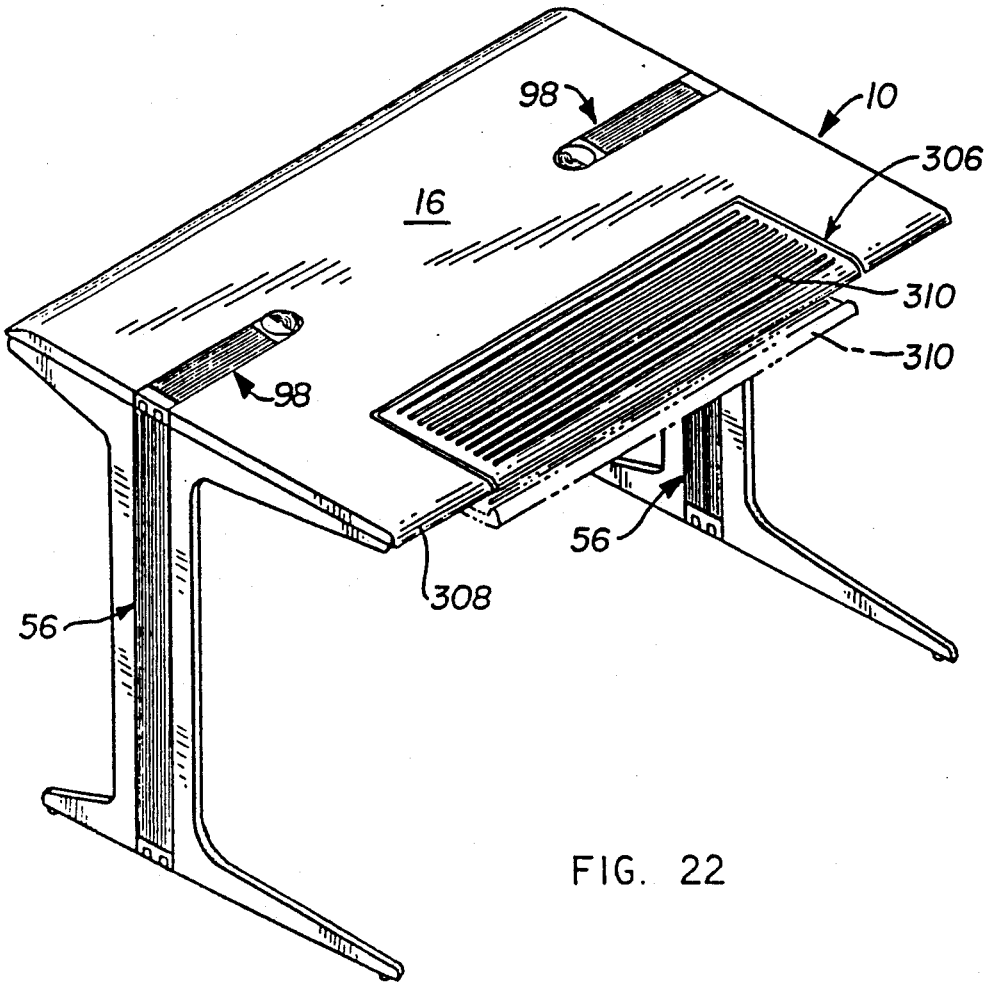
FIG. 22 is a front perspective view of another embodiment of the desk.
Figure 22A:
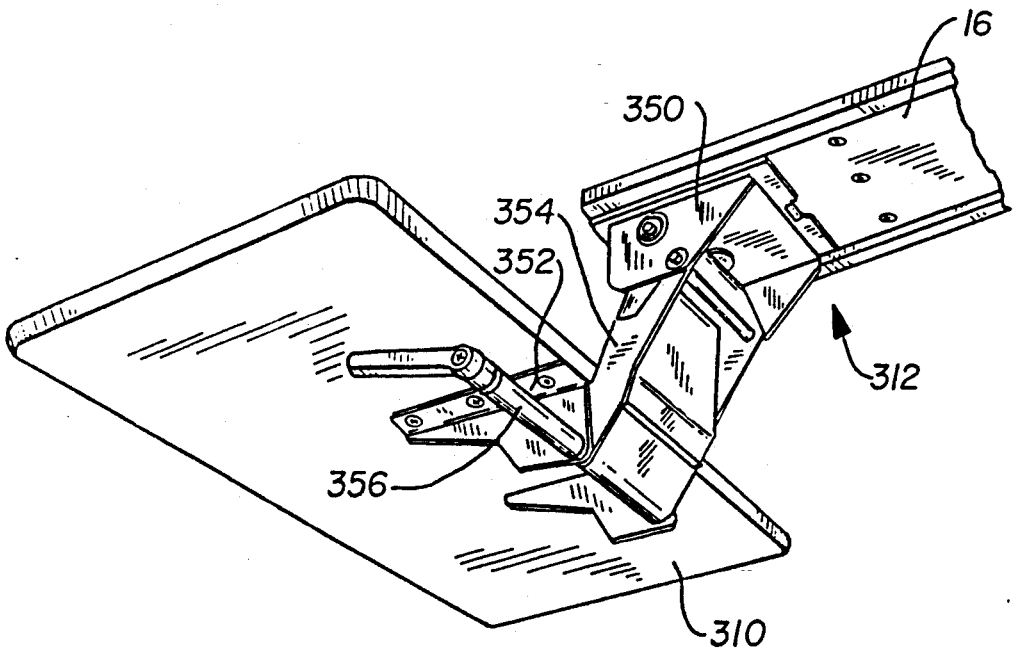
FIG. 22A is a perspective view of a mounting means for adjustably mounting a work tool support member to a desk top.

In another embodiment of the desk 10 having the leg and desk top channels 56, 98, as shown in FIG. 22, the desk top 16 can be provided with a substantially rectangular cut-out portion 306 at the front 308 of the desk and a support 310 of substantially the same dimensions as the cut-out portion 306 mounted to the desk top bottom surface for vertical movement between a lower position below the desk top, shown in chain lines in FIG. 22, and a raised position substantially flush with the top, shown in solid lines. The support 310 is adapted to support a computer keyboard (not shown) or the like, a computer (not shown) connected thereto being supported on the desk top 16. Cables (not shown) associated with the computer can be concealed in the leg and desk top channels 56, 98 as described above with respect to the wiring 60 of the work accessories 62, 105. Movable mounting of the support 310 to the desk top 16 is accomplished by an extensible mounting means 312 known in the art and commercially available from, for example, Webber Knapp, Inc., of Jamestown, N.Y. Such mounting means 312 is illustrated in FIG. 22A and comprises a desk top mounting bracket 350 secured to the desk top, a support mounting bracket 352 to which the support 310 is mounted and an adjustment bracket 354 pivotally mounted to and between the brackets 350, 352 and for facilitating actuation of the support 310 between the lower and raised positions. A locking handle 356 functions to fix the adjustment bracket 354 relative to the brackets 350, 352 to lock the support 310 in the desired adjusted position.

Figure 23:
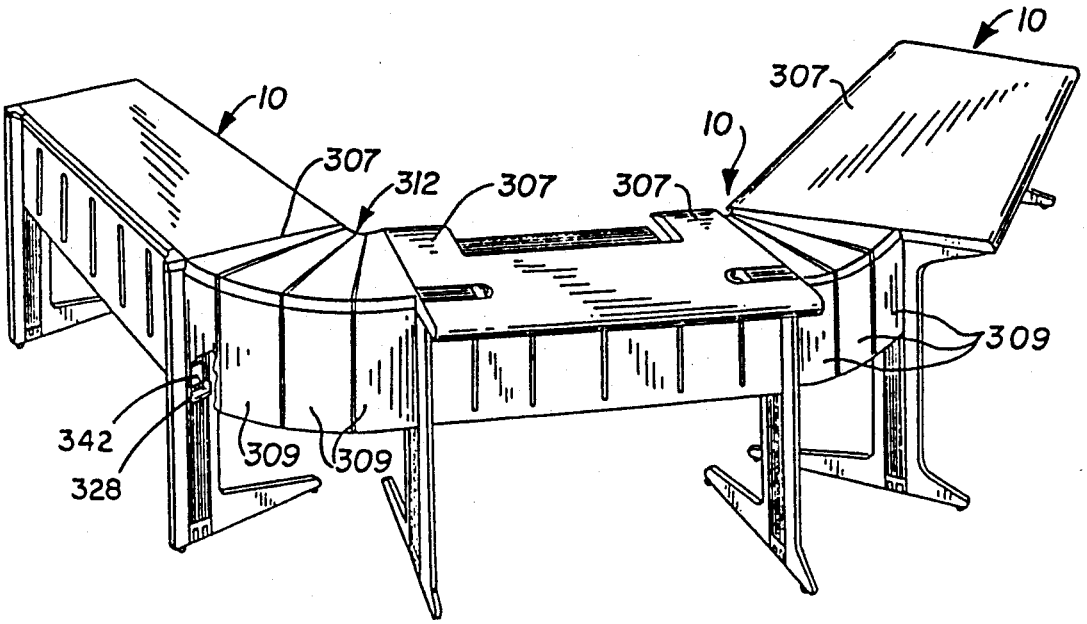
FIG. 23 is a perspective view of a number of desks mounted together in end-to-end relationship and at various angles with respect to one another by spacers.
Figure 24:
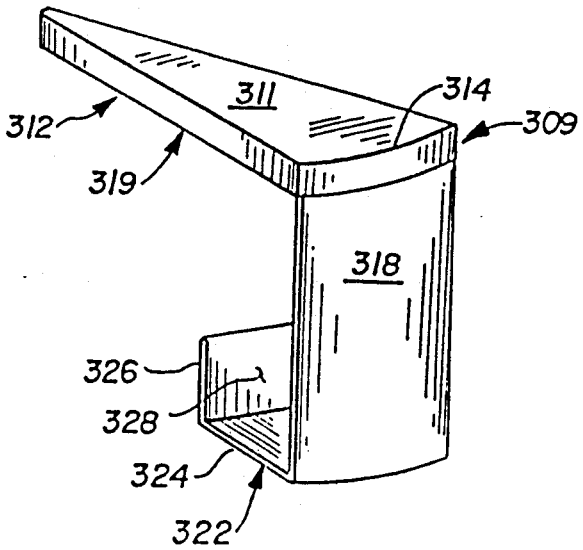
FIG. 24 is a rear perspective view of a spacer.
Figure 25A:
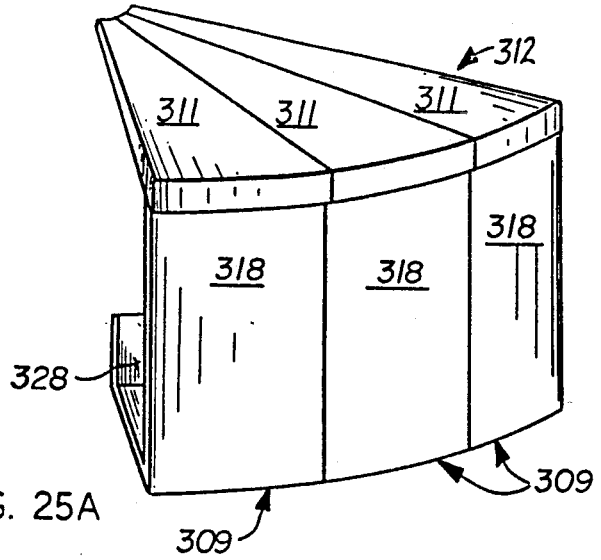
FIGS. 25A, 25B and 25C illustrate alternative embodiments of the spacer.
Figure 25B:
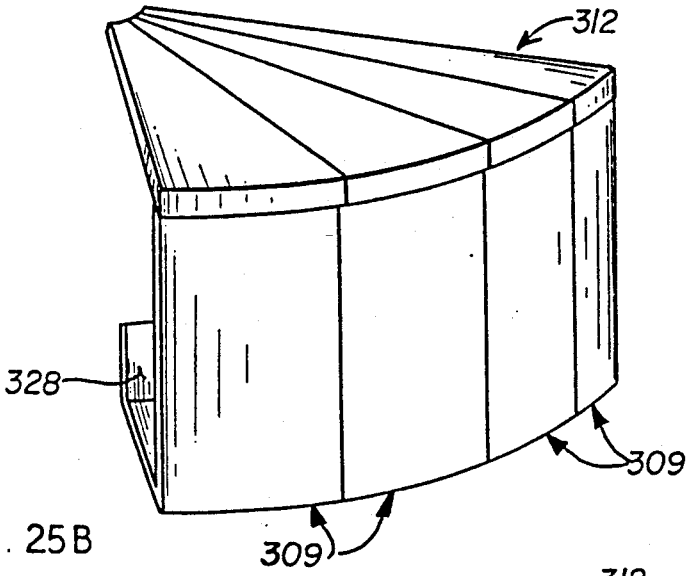
Figure 25C:
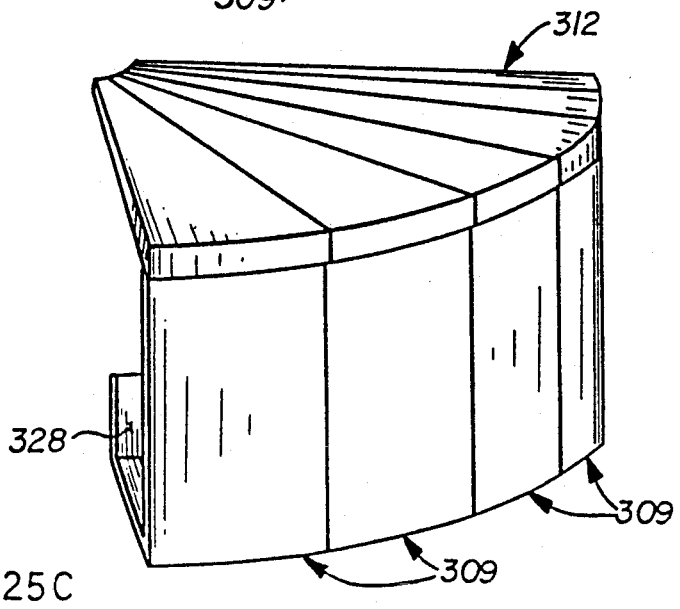

It has been found desirable to link or connect two or more desks 10 of the same or differing embodiment in end-to-end relationship and at angles to one another to form a work station of substantially radial configuration for one or more workers. To this end, as illustrated in FIGS. 23–25, there is provided a spacer 12 mounted between opposing transverse ends 307 of a pair of adjacent desks 10 positioned adjacent to one another at any one of a number of angles. The spacer 12 comprises one or more identical wedge-shaped elements 309 securely mounted together to form a semicircular spacer 312 between the adjacent desks.

As best shown in FIG. 24, each element 309 includes a wedge-shaped horizontal leg 311 having a rear end 314 with a predetermined radius of curvature, and a vertical leg 318 having a radius of curvature complementary to that of the horizontal leg. The vertical leg is securely mounted to the horizontal leg 314 by a plurality of screws (not shown) extending through holes (not shown) in a horizontal lip (not shown) of the vertical leg and into a bottom surface 319 of the horizontal leg. The horizontal leg 311 is preferably constructed of laminate covered particle board. The vertical leg 314 is preferably formed of stamped steel. The apron 20 is also preferably formed of stamped steel.

Although not specifically illustrated in the drawings, the spacer 312 is mounted between the adjacent desks 10 by L-shaped plate-like brackets (not shown) each having a depending flange (not shown) on an end of the bracket. The desk leg 18 is provided with a socket 320, FIG. 17, in the horizontal portion 26 of the front leg support 22 and in which the depending flange of the bracket (not shown) is adapted to register. Specifically, in mounting the spacer 312 to the desk 10, the bolt (not shown) mounting the desk top 16 to the boss 46 of the front leg support 22 is loosened to permit partial removal of the top 16 with respect to the front leg support. Subsequently, the flange of the bracket (not shown) is placed in registry with the socket 320 and the bolt (not shown) is tightened to securely trap the bracket between the desk top and the leg support. The bracket end opposite the flange is then securely mounted to the horizontal leg 311 of the adjacent element 309 by a plurality of screws (not shown) extending holes (not shown) in the bracket and into the bottom surface 319 of the horizontal leg 312 of the element.

As indicated above, one element 309 can be used alone to space a pair of desks at a relatively large angle or two or more elements can be used in connected combination when the desks 10 are positioned at gradually decreasing angles, preferably not less than 90° with respect to one another. In a preferred embodiment of the invention, two, three, four or six linking elements 309 are mounted together to space a pair of desks 10 at angles of 150°, 135°, 120° and 90°, respectively. The elements 309 can be mounted together by elongated plate-like brackets (not shown) mattinqly engaging and securely mounted to, by screws (not shown) or the like, adjacent bottom surfaces 319 of the horizontal legs 311 of the elements.

In another embodiment of the invention, the elements forming a spacer 312 of the above-described preferred types can be integrally formed together, in which case the elongated plate-like mounting brackets (not shown) would be unnecessary.

When the spacer 312 is mounted between the adjacent desks 10, the horizontal leg(s) 311 of the spacer element(s) 309 is substantially flush with the desk tops 16 of the adjacent desks 10 and can function as extensions thereof. In addition, the vertical leg(s) 316 of the spacer 312 is aligned with the aprons 20 of the desks 10. This alignment of the aprons and the vertical leg(s) is an important aspect of the wire management feature of the invention as will be discussed below.

Not only does the vertical leg 316 of the element 309 of the spacer 312 function as a privacy curtain or visual barrier as do the aprons 20 of the desks, but the vertical leg also manages wiring 60 between the desks 10 in the same manner as the aprons 20 of the desks provide wire management. Specifically, as shown in FIGS. 24 and 25, the vertical leg 16 of the element 309 is provided in bottom end 322 of the vertical leg with forwardly- and upwardly-extending portion 324, 326 forming a connecting channel 328 (hereinafter sometimes referred to as the "fourth channel") of the spacer and in which the wiring 60 can be carried between the desks 10.

As stated above, when the spacer 312 is mounted between the adjacent desks 10, the aprons 20 of the same are aligned with the vertical leg 316 of the element 309 and specifically, the channel 328 of the spacer 312 is aligned with the channels 218 of the aprons 20. As can be seen in FIG. 23, although the vertical leg 316 of the element 309 is aligned with the aprons 320 of the adjacent desks 10, the spacer 312 and aprons and thus the channels 218, 328 are separated by the desk legs 18. So that the wiring 60 carried by the channels 218, 328 can be passed through the leg channels 56 between channels 218, 328, the outer leg channel covers 64 are provided with windows (not shown) through which the wiring 60 can pass. In this manner, for example, the wiring 60 carried by the desk top channel 98 of one desk 10 can be fed down through the inner oval slot 116 of the desk top 16 of such desk and into the channel 218 of the apron 20. Wiring 60 can then be passed above inner leg cover 94, into the leg channel 56, out through the window (not shown) in the outer leg channel cover 64 and into the apron channel 328.

While the invention has been described in connection with a preferred embodiment, it will be understood that the invention is not limited to the disclosed embodiment. To the contrary, reasonable variations, alternatives, modifications and equivalents are possible within the scope of the foregoing disclosure without departing from the spirit of the invention as defined by the appended claims.

I claim:

1. In a desk comprising a top having a first end, a first end edge, a work surface, a bottom surface and a central portion, the improvement comprising:

a recess in said work surface extending inwardly from said first end edge toward said central portion to an inner end;

said work surface having an inner slot extending therethrough at said inner end and an outer slot extending therethrough at said first end;

a wire manager assembly received within said recess and partially defining a desk top channel, said wire manager assembly having an inner opening in registry with the inner slot and an outer opening in registry with the outer slot, whereby electrical wiring of work tools positioned on said work surface can be selectively directed through said channel toward said first end edge or through said slot and beneath the bottom surface.

2. A desk according to claim 1, wherein said wire manager assembly further comprises at least one rib extending longitudinally within said desk top channel for segregating electrical wiring received therein.

3. A desk according to claim 1, wherein said wire manager assembly further comprises a base portion securely fastened to said desk top, substantially equal in length to and received within said recess and comprising first and second longitudinal sidewalls, a bottom wall, an open top and a cover mounted to said base portion over said open top, said desk top channel being substantially enclosed by said base portion sidewalls, bottom wall and cover.

4. A desk according to claim 3, wherein said cover is hingeably mounted to one of said base portion longitudinal sidewalls for movement between an open position to permit placement of electrical wiring in said desk top channel and a closed position over said base portion open top and substantially flush with said work surface to substantially enclose electrical wiring received in said desk top channel.

5. A desk according to claim 4, wherein said wire manager assembly further comprises at least one rib extending longitudinally within said desk top channel for segregating electrical wiring received therein.

6. A desk according to claim 3, wherein said inner opening is defined by and between inner portions of said base portion and said cover, and said wire manager assembly further comprises an inner cover on said wire manager assembly inner end and movable between a closed position covering said inner opening and an open position permitting access of electrical wiring to and from said desk top channel away from said first end edge.

7. A desk according to claim 6, wherein said wire manager assembly further comprises a vertical pin on said cover inner end with a hole extending through said inner cover and in registry with said vertical pin, said inner cover being rotatably mounted on said pin about a vertical axis defined by said pin for movement between said open and closed positions.

8. A desk according to claim 7, wherein said inner cover further comprises a handle for facilitating movement of said inner cover between said open and closed positions.

9. A desk according to claim 8, wherein said base portion inner end, said inner opening and said inner cover are generally semicircular in shape, said hole through said inner cover is eccentric with respect thereto and said inner cover is rotatable about said second pin approximately 180° between fully open and closed positions.

10. A desk according to claim 6, further comprising at said first end thereof a substantially vertical leg covering said recess at said desk top first end edge, said outer opening extending through said vertical leg and permitting access of electrical wiring to and from said desk top channel at said desk top first end edge.

11. A desk according to claim 10, further comprising outer closure means on said vertical leg, covering said outer opening and permitting access of electrical wiring to and from said desk top channel.

12. A desk according to claim 11, wherein said outer closure means comprises at least one pair of resilient doors mounted to said vertical leg over said outer opening.

13. A desk according to claim 2, wherein said wire manager assembly base portion further comprises inner and outer deep portions and a central shallow portion having substantially the same dimensions as and received in said inner and outer slots and said recess, respectively, said cover being substantially flush with said work surface, said base portion bottom wall being open at said inner and outer deep portions and said inner and outer deep portions being in registry with said inner and outer slots; and said desk further comprises opposite ends and a panel mounted to said desk top bottom surface, extending between said desk opposite ends and comprising a wire channel in registry with said desk top channel;

whereby electrical wiring can be channeled from said desk top work surface to said desk opposite ends through said desk top channel and said wire channel.

14. A desk according to claim 13, wherein said wire manager assembly further comprises at least one rib extending longitudinally within said desk top channel and for segregating electrical wiring received in said desk top channel.

15. A desk according to claim 14, wherein said rib comprises a divider wall extending upwardly from said base portion bottom wall at said central shallow portion thereof and extending longitudinally therewith.

16. A desk according to claim 15, further comprising fastening means for securing the wire manager assembly to the desk top, said fastening means comprising a plurality of holes extending through said base portion bottom wall at said central shallow portion thereof and an equal number of screws received in said holes and threadably engaging said desk top between said inner and outer slots.

17. A desk according to claim 1, wherein said desk top further comprises a second end being a mirror image of said first end, said first and second ends being positioned at opposite ends of said desk and being substantially identical with respect to said recess and said wire manager assembly.

18. A desk according to claim 1, wherein said desk top has a second end, and said desk top further comprises a panel mounted to said desk top bottom surface, extending between said desk top first and second ends and comprising and defining a wire channel in registry with said desk top channel;

whereby electrical wiring can be channeled from said desk top work surface to said desk top first end through said desk top channel and said wire channel.

19. In a desk comprising opposite ends, a top having a work surface and a bottom surface, and a panel extending substantially horizontally between said opposite ends and substantially vertically downwardly from said bottom surface a predetermined distance for providing privacy to a worker at said desk, the improvement wherein:

said desk top has a channel in said work surface extending therein from an end, and an opening extending therethrough in registry with the channel; and said panel further comprises a channel extending substantially the full length thereof beneath and parallel to the bottom surface and in registry with said opening;

whereby electrical wiring of work tools on said work surface can be selectively channeled from said work surface to said desk opposite ends through said opening and one of said desk top channel and said panel channel.

20. A desk according to claim 19, wherein said panel is substantially J-shaped, in cross section, and further comprises a relatively long, substantially vertical leg extending downwardly from and substantially normal to said desk top bottom surface, a relatively short, substantially vertical leg positioned in substantially parallel spaced relationship to said long vertical leg and an intermediate leg between said long and short vertical legs, aid channel being defined by and between said long and short vertical legs and said intermediate leg.

21. A desk according to claim 20, wherein said panel is an integrally formed one-piece member and said intermediate leg is substantially horizontal and extends between and is formed integral with lower ends of said long and short vertical legs.

22. A desk according to claim 20, further comprising mounting means securely mounting said panel to said desk top bottom surface, said mounting means comprising a substantially horizontal first mounting flange on and extending normal to an upper end of said long vertical leg and engaging said desk top bottom surface, at least one pair of aligned openings extending through said first mounting flange and said desk top bottom surface, and at least one screw in registry with said aligned openings and threadably engaging said desk top to securely mount said panel to said top.

23. A desk according to claim 19, wherein said desk further comprises a pair of legs supporting said desk top at opposite ends of said desk; and said panel is securely mounted to and between said legs, said panel means thereby further providing lateral stability to said desk.

24. A desk according to claim 23, wherein said legs are substantially identical and each of said legs comprises first and second supports and at least one pair of overlapping plates extending from said first and second supports; and said desk further comprises securing means for securely mounting said plates together in overlapping relationship.

25. A desk according to claim 24, wherein said securing means comprises a pair of aligned holes extending through said overlapping plates and a screw in registry with said aligned holes and threadably engaging said plates; and an end edge of said panel has at least one second mounting flange engaging said pair of overlapping plates and having an opening aligned with said aligned holes in said overlapping plates, said screw being in registry with said aligned holes and openings and threadably engaging said plates and said mounting flange to securely mount said panel to said legs.

26. A desk according to claim 19, wherein said desk further comprises a pair of legs supporting said desk top at opposite ends of said desk, said legs comprising leg channels extending substantially the full length of said legs and in registry with at least one of said desk top channel and panel channel;

whereby electrical wiring can be selectively channeled from said work surface to said desk opposite ends and to a floor through said opening, said desk top channel, said panel channel and said leg channels.

27. A desk according to claim 26, wherein said legs are substantially identical and each of said legs comprises first and second supports positioned in spaced-apart relationship and at least one pair of overlapping plates extending from said first and second supports, said leg channel defined by and between said spaced first and second support and said overlapping plates; and said desk further comprises securing means for securely mounting said plates together in overlapping relationship.

28. A desk according to claim 27, wherein said panel is substantially J-shaped in cross section and further comprises a relatively long, substantially vertical leg extending downwardly from and substantially normal to said desk top bottom surface, a relatively short, substantially vertical leg positioned in substantially parallel spaced-apart relationship to said long vertical leg and an intermediate leg between said long and short vertical legs, said panel channel being defined by and between said long and short vertical legs and said intermediate leg.

29. A desk according to claim 28, wherein said panel comprises a substantially horizontal first mounting flange on and extending normal to an upper end of said long vertical leg and engaging said desk top bottom surface, and said desk top has at least one pair of aligned openings within said first mounting flange and said desk top and at least one screw in registry with said aligned openings and threadably engaging said desk top to securely mount said panel means to said top.

30. A desk according to claim 29, wherein said securing means comprises a pair of aligned holes extending through said overlapping plates and a screw in registry with said aligned holes and threadably engaging said plates; and said panel is securely mounted to and between said legs, said panel thereby further providing lateral stability to said desk, and a transverse end of said long vertical part having at least one second mounting flange engaging said pair of overlapping plates and having an opening aligned with said aligned holes in said overlapping plates, said screw being in registry with said aligned holes and opening and threadably engaging said plates to securely mount said panel to said leg.

31. A desk according to claim 26, wherein said desk top further comprises front and rear sides;

said desk further comprises means at said desk top front side for supporting a work tool, and bracket means for movably mounting said support means to said desk at a variety of adjusted positions for convenient access thereto.

32. A desk according to claim 31, wherein said desk top further comprises a cut out portion at said desk top front side, said support means is complementary to said cut out portion and said bracket means movably mounts said support means to said desk top bottom surface for vertical movement between an upper position substantially flush with said desk top and a lower position below said top.

33. A desk according to claim 19, wherein said desk top further comprises front and rear sides;

said desk further comprises means at said desk top front side for supporting a work tool, and bracket means for movably mounting said support means to said desk at a variety of adjusted positions for convenient access thereto.

34. A desk according to claim 33, wherein said desk top further comprises a cut out portion at said desk top front side, said support means is complementary to said cut out portion and said bracket means movably mounts said support means to said desk top bottom surface for vertical movement between an upper position substantially flush with said desk top and a lower position below said desk top.

35. A desk according to claim 34, wherein said support means further comprises lip means extending along a front longitudinal side thereof for preventing inadvertent movement of a work tool on said support means.

* * * * *

UNITED STATES PATENT AND TRADEMARK OFFICE

CERTIFICATE OF CORRECTION

PATENT NO. : 5,237,935

DATED : August 24, 1993

INVENTOR(S) : THOMAS J. NEWHOUSE et al.

It is certified that error appears in the above-identified patent and that said Letters Patent is hereby corrected as shown below:

Col. 21, claim 13, line 3:
"2" should be --3--;

Col. 22, claim 20, line 16:
"aid" should be --said--.

Signed and Sealed this

Twenty-second Day of March, 1994

*Attest:*

*Attesting Officer*

BRUCE LEHMAN

*Commissioner of Patents and Trademarks*